US011796179B2

(12) United States Patent
Kim

(10) Patent No.: US 11,796,179 B2
(45) Date of Patent: Oct. 24, 2023

(54) HOME APPLIANCE WITH KNOB ASSEMBLY

(71) Applicant: LG ELECTRONICS INC., Seoul (KR)

(72) Inventor: Haemin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 196 days.

(21) Appl. No.: 17/504,713

(22) Filed: Oct. 19, 2021

(65) Prior Publication Data

US 2022/0170641 A1 Jun. 2, 2022

(30) Foreign Application Priority Data

Nov. 27, 2020 (KR) ..... 10-2020-0162937

(51) Int. Cl.
*G05G 1/10* (2006.01)
*F24C 3/12* (2006.01)
(Continued)

(52) U.S. Cl.
CPC ..... *F24C 3/126* (2013.01); *F24C 7/085* (2013.01); *G05G 1/12* (2013.01); *G05G 1/10* (2013.01); *G05G 5/005* (2013.01)

(58) Field of Classification Search
CPC ..... G05G 1/08; G05G 1/082; G05G 1/087; G05G 1/10; G05G 1/12; G05G 5/005;
(Continued)

(56) References Cited

U.S. PATENT DOCUMENTS 2,780,333 A * 2/1957 Reiser ..... G05G 1/082 74/528
2,797,592 A * 7/1957 Marrapese ..... G05G 1/10 74/504
(Continued)

FOREIGN PATENT DOCUMENTS

IE 902691 A1 * 2/1991 ..... F24C 3/126
KR 10-2018-0095408 8/2018
(Continued)

*Primary Examiner* — Richard W Ridley
*Assistant Examiner* — Brian J McGovern
(74) *Attorney, Agent, or Firm* — KED & ASSOCIATES

(57) ABSTRACT

A cooking appliance may include a panel provided with a through hole; a knob assembly installed at the panel; and a valve disposed inside of the panel. The knob assembly may include a shaft that passes through the through hole, configured to move in an axial direction between a first axial position and a second axial position and rotate around a rotational center; a knob disposed outside of the panel, connected to the shaft, and configured to move with the shaft in the axial direction and rotate with the shaft; a frame installed at the panel and configured to support rotation of the shaft; a rotational member connected to the shaft, configured to move and rotate with the, and having a diameter larger than a diameter of the shaft; a first rotation limiting portion provided on the frame at a first circumferential position; a second rotation limiting portion provided to the rotational member at a second circumferential position, engaged with the first rotation limiting portion at the first axial position and interfering therewith in the circumferential direction in a state in which the first circumferential position and the second circumferential position correspond to each other, and disengaged from the first rotation limiting portion at the second axial position and not interfering therewith the circumferential direction; and an elastic member configured to elastically support the shaft.

20 Claims, 18 Drawing Sheets

(51) Int. Cl.
*F24C 7/08* (2006.01)
*G05G 1/12* (2006.01)
*G05G 5/00* (2006.01)

(58) Field of Classification Search
CPC .. G05G 5/02; G05G 5/03; G05G 5/05; G05G 5/06; H01H 3/08; H01H 3/10; H01H 19/14; H01H 2019/143; F24C 3/12; F24C 3/122; F24C 3/124; F24C 3/126; F24C 3/128; F24C 7/08; F24C 7/081; F24C 7/082; F24C 7/083; F24C 7/085
See application file for complete search history.

(56) References Cited

U.S. PATENT DOCUMENTS 3,362,635 A * 1/1968 Forte ..... H05B 1/0225 236/51
3,986,409 A * 10/1976 Tripp ..... G05G 1/02 74/553
4,549,716 A * 10/1985 Warren ..... G05G 1/082 74/25
5,513,831 A * 5/1996 Seward ..... F16K 35/027 74/25
5,771,878 A * 6/1998 Lewis ..... G05G 1/02 431/153
5,839,426 A * 11/1998 Aretxaga ..... F24C 3/124 126/39 N
2007/0187215 A1* 8/2007 Lavigne ..... H01H 3/20 200/4
2017/0227231 A1* 8/2017 Pionek ..... F24C 3/124
2017/0235328 A1* 8/2017 Swayne ..... G05G 5/005 74/532
2018/0238465 A1* 8/2018 Ha ..... G05G 1/12
2018/0238550 A1* 8/2018 Ha ..... F24C 3/126
2018/0238552 A1* 8/2018 Ha ..... G05G 1/10
2018/0238553 A1* 8/2018 Ha ..... G05G 1/12
2018/0238554 A1* 8/2018 Ha ..... G05G 5/04
2018/0239386 A1* 8/2018 Ha ..... F23N 5/203
2019/0024903 A1* 1/2019 Ha ..... G05G 1/10
2019/0032921 A1* 1/2019 Ha ..... F24C 3/124
2019/0033908 A1* 1/2019 Ha ..... F24C 3/126

FOREIGN PATENT DOCUMENTS

KR 10-2018-0095439 8/2018
KR 10-2133283 7/2020
KR 10-2020-0122174 10/2020

* cited by examiner

HOME APPLIANCE WITH KNOB ASSEMBLY

CROSS-REFERENCE TO RELATED APPLICATION(S)

This application claims priority to and the benefit of Korean Patent Application No. 10-2020-0162937, filed in Korea on Nov. 27, 2020, the disclosure of which is incorporated herein by reference in its entirety.

BACKGROUND

1. Field

A home appliance with a knob assembly, and more specifically, a cooking appliance with a knob assembly are disclosed herein.

2. Background

Home appliances are provided with a knob for controlling operation of the home appliances. In particular, a knob included in a cooking appliance is connected to a valve or a rotational sensor, for example, and used for adjustment of a thermal power, for example. The knob may be used for all types of cooking appliances including a cooking appliance that burns gas, a highlight-type cooking appliance that generates heat using a heat generating coil, and an induction heating-type cooking appliance that generates heat directly in a cooking vessel by generating an electromagnetic field, for example. Ordinarily, a cooking appliance has a same number of knobs as a number of burners.

Among home appliances, a cooking appliance uses a knob to control an operation of generating heat. It can be dangerous to unintentionally rotate the knob. Accordingly, the knob applied to the cooking appliance is designed to rotate in a state of being pushed in an axial direction. The axial direction means a longitudinal direction of the shaft.

FIGS. 1 and 2 show a related art rotation limiting structure, applied to a knob assembly structure used for a cooking appliance. A knob ring 68 is disposed on a panel 10 forming an exterior of the cooking appliance, and includes a shaft supporting tube 676 that supports a first shaft 41 of a knob 30. In a state of being inserted into the shaft supporting tube 676, the first shaft 41 can move in a axial direction thereof and rotate around a rotational center RC thereof. The first shaft 41 is elastically supported by an elastic component forward in the axial direction. That is, when the knob 30 is pushed rearward in the axial direction, the knob 30 moves rearward, but when the knob 30 is released from the force of pushing the knob 30, the knob 30 receives a force for returning forward from the elastic component.

A locker 20 protrudes forward from the panel 10 in a space encircled by the knob ring 68. A boss 21 that protrudes outward in a radial direction is provided at an end of a front of the locker 20. Additionally, a rear surface member 33 provided on a rear surface of the knob 30 is provided with a hole 34 in which the locker 20 is accommodated. The hole 34 provides a passage through which the locker 20 is inserted into an inner space of the knob 30. A boss groove 35, expanded further than the hole 34 in the radial direction, may be provided on an outer circumference of the hole 34.

Referring to FIG. 2, in a state in which the knob 30 is not pushed rearward in the axial direction, the boss 21 is accommodated in the boss groove 35. In this state, as the boss 21 interferes with the rear surface member 33 of the knob 30 in a circumferential direction, rotation of the knob 30 is prevented, although a user may try to rotate the knob 30. For the user to rotate the knob 30, the user may push the knob 30 rearward in the axial direction, and in a state in which the boss 21 is completely inserted into the inner space of the knob 30, rotates the knob 30.

When the knob 30 is pushed rearward in the axial direction and rotated, a rear surface of the boss 21 interferes with a front surface of the rear surface member 33 of the knob 30 in a frontward-rearward direction. Accordingly, forward movement of the knob 30 caused by elasticity of a spring may be limited. That is, the rear surface of the boss 21 and the front surface of the rear surface member 33 of the knob 30 receive a force in a direction in which the rear surface of the boss 21 and the front surface of the rear surface member 33 of the knob 30 closely contact each other due to the elastic force of the spring.

To implement the knob rotation limiting structure of the related art, the locker 20 needs to be fixed to the panel 10, and the rear surface member 33 needs to be installed in the knob 30, causing an increase in the number of components and assembly man-hours. Additionally, the rear surface of the boss 21 and the front surface of the rear surface member 33 continue to receive elastic force. Accordingly, noise may be created and wear may occur due to friction. When the knob 30 having rotated returns to an initial position and is moved forward by the elasticity of the spring, the boss 21 returns to the boss groove 35 suddenly, making noise.

Further, in the knob rotation limiting structure of the related art, the locker 20 is disposed in the space encircled by the knob ring 68. Accordingly, when the knob ring 68 is disassembled for management and repair of a product, the locker 20 needs to be disassembled first, causing inconvenience to a user.

A related knob rotation limiting structure is disclosed in Korean Patent No. 2133283 and Korean Patent Publication No. 2020-0122174, which are hereby incorporated by reference.

BRIEF DESCRIPTION OF THE DRAWINGS

Embodiments will be described in detail with reference to the following drawings in which like reference numerals refer to like elements, and wherein.

DETAILED DESCRIPTION

Figure 1:
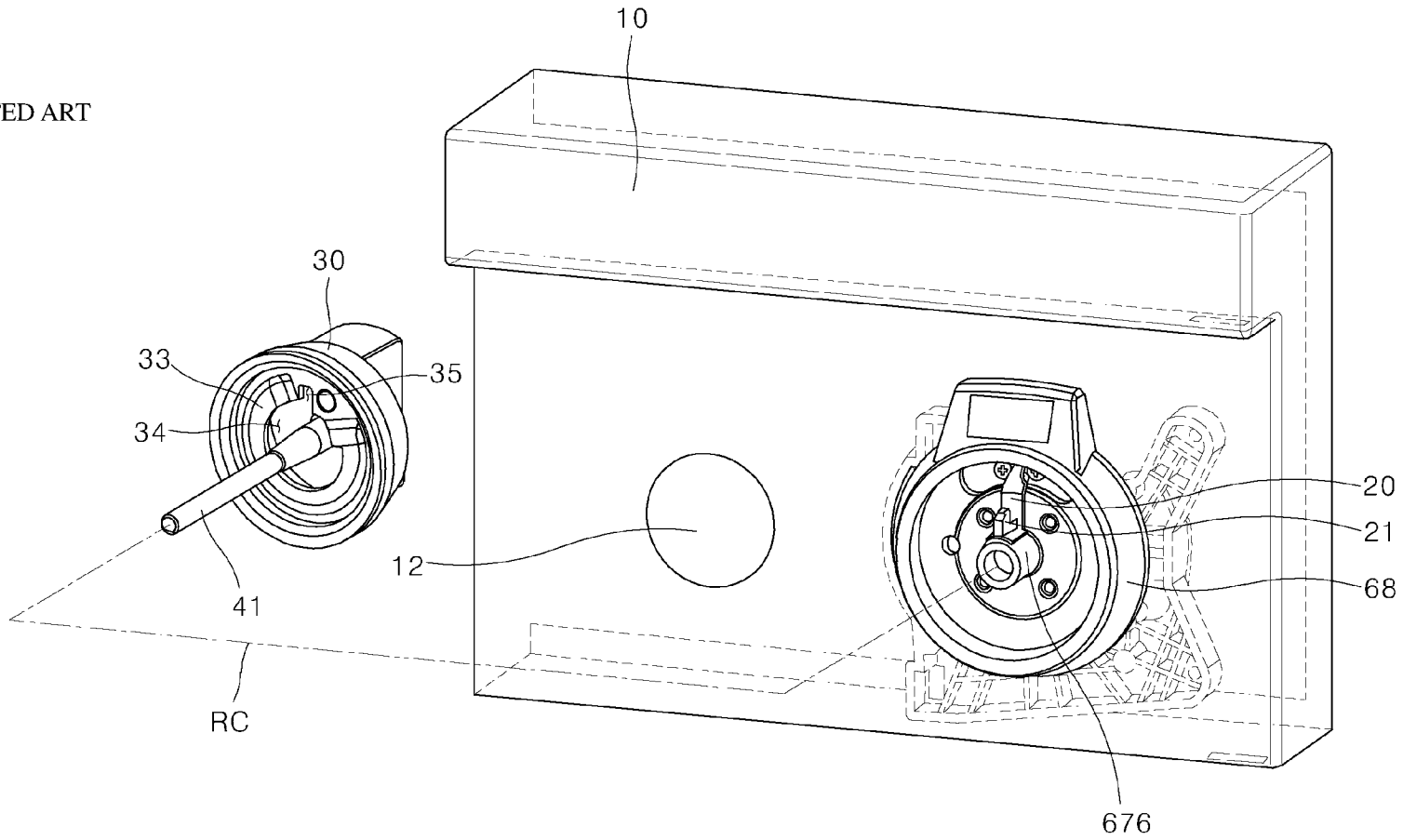
FIG. 1 RELATED ART
FIG. 1 is a perspective view of a related art knob assembly in which a knob rotation limiting structure is applied onto a rear surface member of a knob and a locker.
Figure 2:
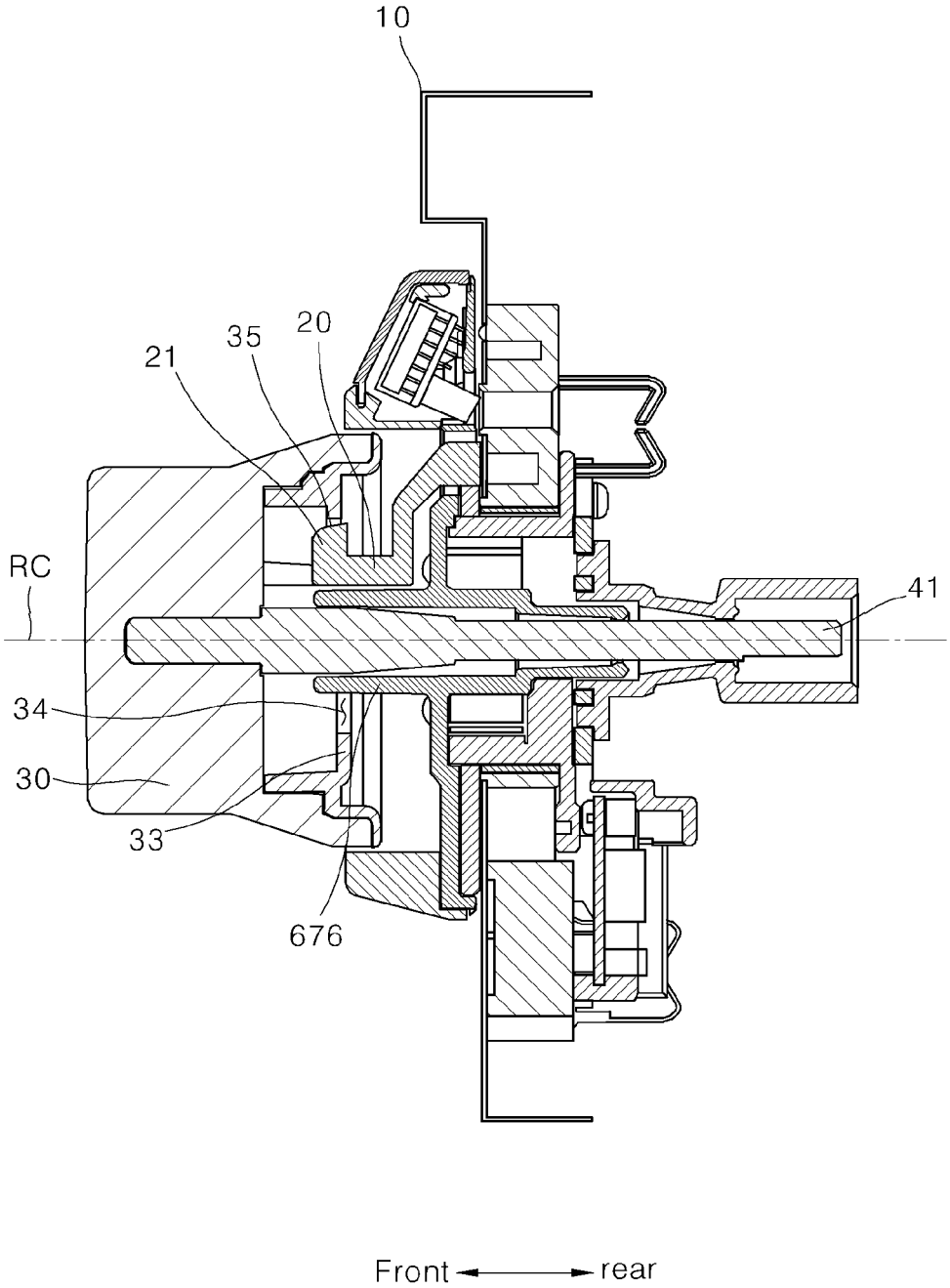
FIG. 2 RELATED ART
FIG. 2 is a side cross-sectional view of the knob assembly of FIG. 1.

Features and advantages are specifically described hereinafter with reference to the accompanying drawings such that one having ordinary skill in the art to which embodiments pertain may easily implement the technical spirit. In the disclosure, detailed descriptions of known technologies in relation to the disclosure are omitted if they are deemed to make the gist unnecessarily vague. Hereinafter, embodiments are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Throughout, each component can be provided as a single one or a plurality of ones, unless explicitly stated to the contrary.

When one component is described as being "in an upper portion (or a lower portion)" of another component, or "on (or under)" another component, one component can be disposed on the upper surface (or under the lower surface) of another component, and an additional component can be interposed between another component and one component on (or under) another component.

When one component is described as being "connected", "coupled", or "connected" to another component, one component can be directly connected, coupled, or connected to another component. However, it is also to be understood that an additional component can be "interposed" between the two components, or the two components can be "connected", "coupled", or "connected" through an additional component.

Herein, the singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

The singular forms "a", "an" and "the" are intended to include the plural forms as well, unless explicitly indicated otherwise. It should be further understood that the terms "comprise" or "include" and the like, set forth herein, are not interpreted as necessarily including all the stated components or steps but can be interpreted as excluding some of the stated components or steps or can be interpreted as including additional components or steps.

Throughout the disclosure, the terms "A and/or B" as used herein can denote A, B or A and B, and the terms "C to D" can denote C or greater and D or less, unless stated to the contrary.

Hereinafter, embodiments are described with reference to the drawings.

In description of embodiments, an axial direction denotes a length-wise direction of a shaft. A front denotes a direction from the shaft toward a knob along the axial direction, and a rear denotes a direction from the shaft toward a valve along the axial direction. Further, a radial direction denotes a direction farther away from the shaft (a centrifugal direction) or a direction closer to the shaft (a centripetal direction).

Furthermore, a circumferential direction denotes a direction in which a circumference of the shaft is encircled, and understandably, corresponds to a direction in which the shaft rotates.

Figure 3:
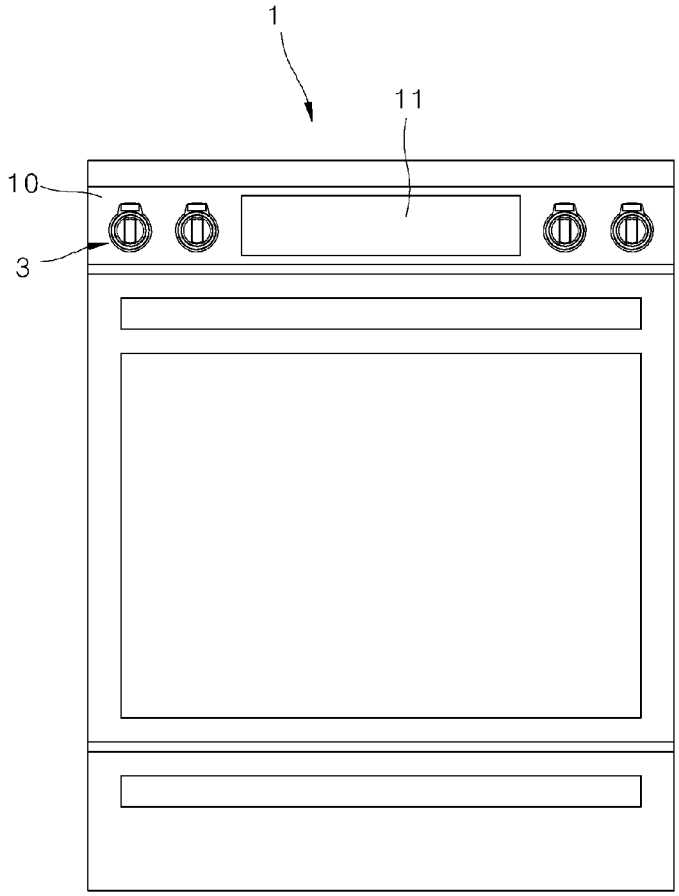
FIG. 3 is a front view of a cooking appliance with a knob assembly according to an embodiment.
Figure 4:
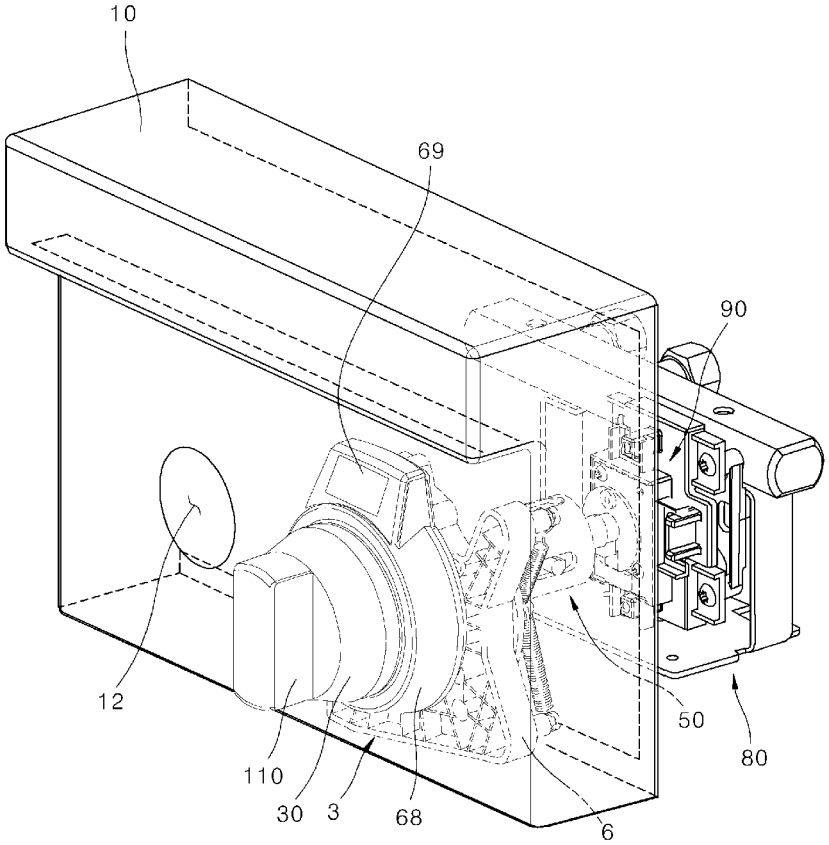
FIG. 4 is an enlarged perspective view showing the knob assembly of FIG. 3.

A cooking appliance-appropriate knob assembly in embodiments may be applied to a cooking appliance 1, as illustrated in FIG. 3. The cooking appliance 1 may have a structure in which a cooktop is disposed on an oven. Knob assembly 3 may be installed in a panel 10 in an upper portion of a front surface of the cooking appliance 1.

For the knob assembly 3 according to this embodiment, a knob ring 68 may be provided with a display 69, and a knob 30 and the knob ring 68 may independently rotate. Accordingly, the knob assembly 3 may be used for various types of input, and the display 69 provided on the knob assembly 3 itself may display a current state of the cooking appliance 1. As the knob assembly 3 may be used for various types of input, a large main display 11 without a physical input button may be additionally disposed on the panel 10 of the cooking appliance 1.

The knob assembly, to which a knob rotation limiting structure is applied, according to this embodiment is described with reference to FIGS. 4 to 18. The knob assembly 3 may be provided with knob 30 disposed at a front of the panel 10 and exposed to the outside. The knob 30 may include a body 31 having a circular shape, and a grip 32 that protrudes from a front surface of the body 31 forward.

The knob assembly 3 may include a shaft 40. The shaft 40 may include a first shaft 41 and a second shaft 42 which are disposed in a row in the axial direction. A joint 50 may be installed between the first shaft 41 and the second shaft 42. The joint 50 may reduce/remove a deviation in a gap between the first shaft 41 and the second shaft 42, and reduce an error in positions of shaft centers of the first shaft 41 and the second shaft 42 even if the shaft centers are eccentric or not aligned with each other. Additionally, the joint 50 may deliver a rotational force of the first shaft 41 to the second shaft 42.

An end of a front of the first shaft 41 may connect to a rotational center RC of the knob 30. The first shaft 41 may integrally connect to the knob 30 or be manufactured separately and then connected and assembled to the knob 30. The first shaft 41 may pass through a through hole 12 formed in the panel 10 and extend in a frontward-rearward direction. The first shaft 41 may be supported by a frame 6 installed in the panel 10 near the through hole 12, and in the state of being supported by the frame 6, make translational motions in the axial direction and rotate about the rotational center RC.

Figure 7:
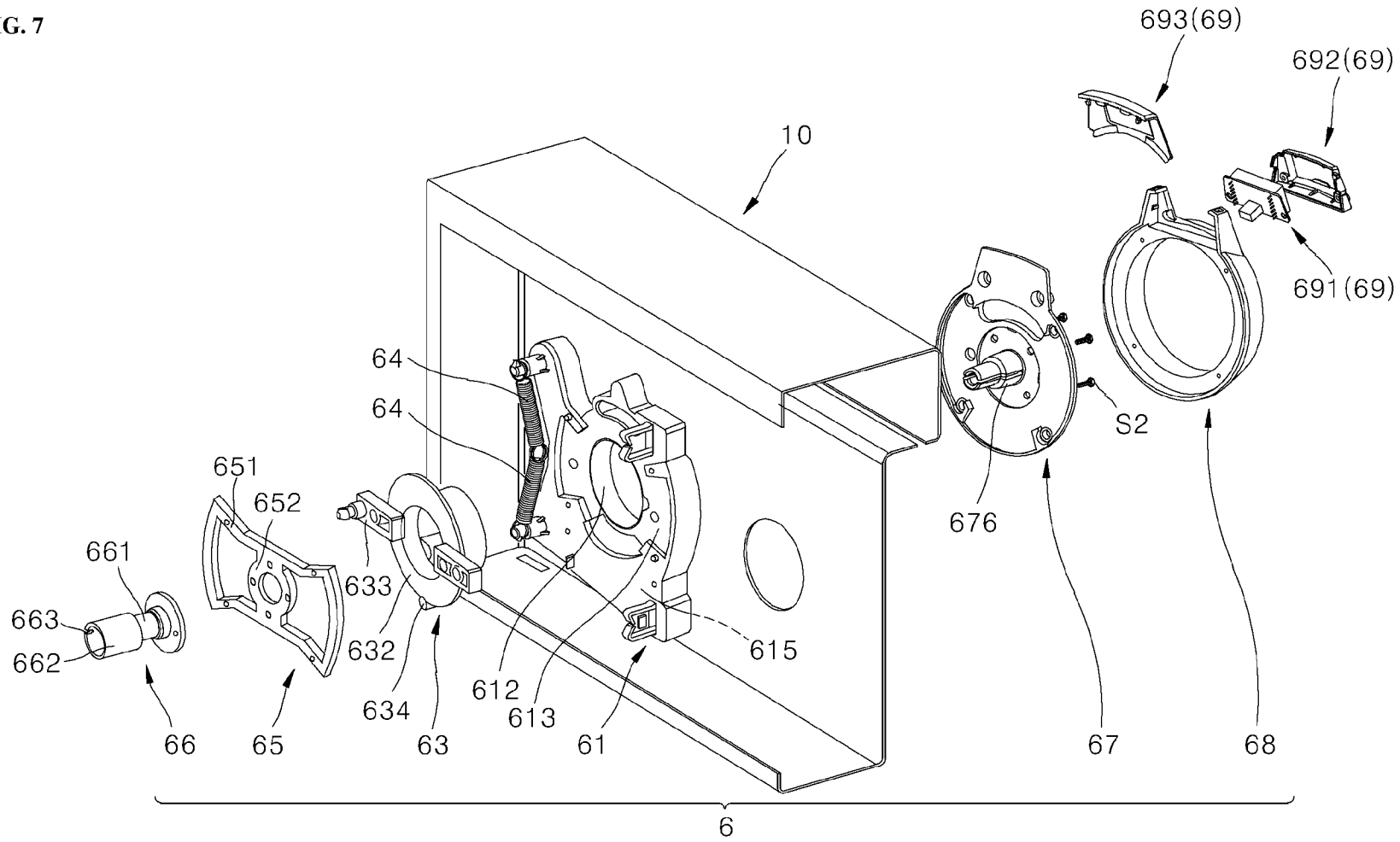
FIG. 7 is an exploded perspective view showing a rear of a support frame and a knob ring according to an embodiment.
Figure 8:
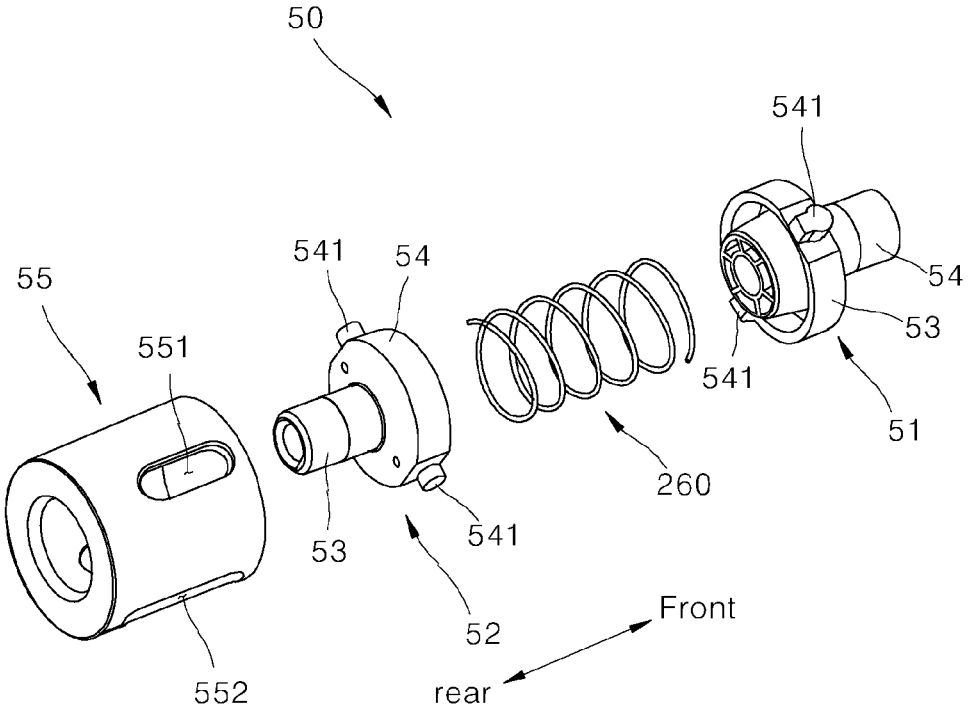
FIG. 8 is an exploded perspective view showing a rear of a joint according to an embodiment.
Figure 9:
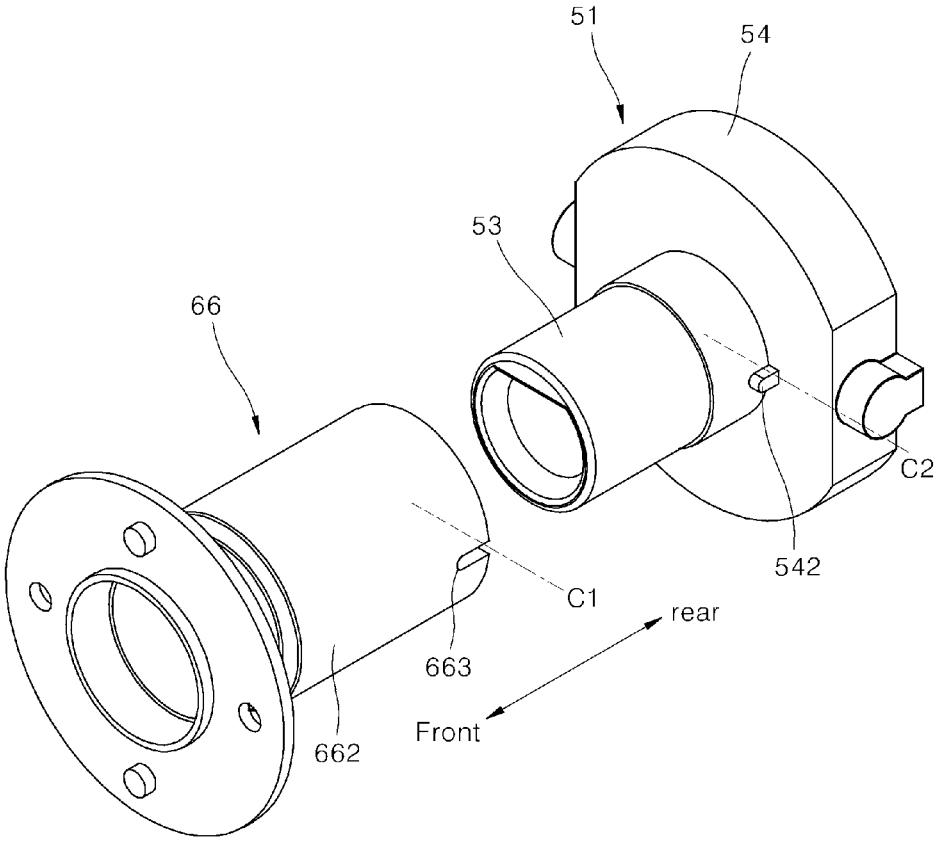
FIG. 9 is an exploded perspective view showing a component to which a rotation limiting structure is applied, in a frame and a joint according to an embodiment.

Referring to FIG. 7, the frame 6 may include a component that remains fixed to the panel 10, and a component that rotates relative to the panel 10. The component that remains fixed to the panel 10 may include a support frame 61, a fixed frame 65, and a tube frame 66, which are described hereinafter. The component that rotates relative to the panel 10 may include an inner rotation ring 63, an outer rotation ring 67, and knob ring 68.

The frame 6 may include the support frame 61 which may be fixed to a rear surface of the panel 10 in contact with a rear surface of the panel 10 in a way that the support frame 61 encircles the through hole 12 of the panel 10. The support frame 61 may be provided with a circular journal 612 corresponding to the through hole 12 of the panel 10. The inner rotation ring 63 may be rotatably installed in the circular journal 612.

The inner rotation ring 63 may include a circular tube 631 inserted into the circular journal 612. The inner rotation ring 63 may further include a ring-shaped flange 632 that extends from an end of a rear of the circular tube 631 outward in the radial direction. A diameter of the flange 632 may be greater than an inner diameter of the circular journal 612.

The inner rotation ring 63 may further include a pair of arms 633 that extends from the end of the rear of the circular tube 631 in the radial direction. Each arm 633 may extend further outward than the flange 632 in the radial direction and protrude further rearward than the flange 632. An inner circumferential surface of the circular journal 612 may guide rotation of the inner rotation ring 63 while directly or indirectly contacting the circular tube 631 fitted into the circular journal 612 from a rear of the circular journal 612.

An end of an outside of the arm 633 in the radial direction may be connected to the support frame 61 by a pair of springs 64. Accordingly, the inner rotation ring 63 may stay at a position where elasticity of the pair of springs 64 is in equilibrium, and the position may be an initial position. When the inner rotation ring 63 rotates clockwise or counterclockwise from the initial position, elastic forces of the pair of springs 64 may differ from each other, and the elastic forces may act as forces allowing the inner rotation ring 63 to return to the initial position.

A mounting surface 613 may be provided on a rear surface of the support frame 61 in such a way that a circumference of the circular journal 612 is depressed. The mounting surface 613 may have a shape corresponding to the flange 632, and further have a shape corresponding to the arm 633. The shape of the mounting surface 613, corresponding to the arm 633, may include an area in which the arm 633 rotates by a predetermined angle. Accordingly, the mounting surface 613 may have a bow tie-like shape.

The flange 632 may be mounted onto the mounting surface 613 and limit forward movement of the inner rotation ring 63. The arm 633 may also be mounted onto the mounting surface 613 and limit forward movement of the inner rotation ring 63.

In a state of being mounted in the mounting surface 613, a range of rotation of the arm 633 may be limited as a result of interference with an inner circumferential wall of the mounting surface 613. Accordingly, a range of rotation of the inner rotation ring 63 may be limited.

The flange 632 may be provided with a first sensed portion 634 on an edge thereof. The first sensed portion 634 may be a magnet provided at a lower end of the flange 632. In the support frame 61, a first sensor 615 configured to sense a position of the first sensed portion 634 may be installed in a space under the circular journal 612. The first sensor 615 may be a Hall sensor that senses a magnetic force of the magnet.

The frame 6 may further include fixed frame 65 fixed to the rear surface of the support frame 61 from a rear of the support frame 61. Accordingly, the fixed frame 65 may be indirectly fixed to the panel 10 through the support frame 61.

The fixed frame 65 may be fixed to a rear of the inner rotation ring 63. The fixed frame 65 may include an outer frame 651 formed into a bow tie-shaped closed loop approximately corresponding to the mounting surface 613. The fixed frame 65 may contact a rear surface of the flange 632 to prevent the inner rotation ring 65 from moving rearward. The arm 633 may be accommodated in a closed loop shape-inner space of the fixed frame 65 and rotate within a predetermined range of rotation, and may interfere with the fixed frame 65 and rotate within a limited range of rotation.

The fixed frame 65 may be further provided with an inner frame 652 connected to the outer frame 651, in a central portion thereof. The inner frame 652 may be provided with a hole through which the first shaft 41 may pass.

The frame 6 may further include tube frame 66 fixed to a central portion of the fixed frame 65 from a rear of the fixed frame 65. Accordingly, the tube frame 66 may be indirectly fixed to the panel 10 through the fixed frame 65 and the support frame 61.

The tube frame 66 may include an extended tube 661 that extends rearward from the central portion of the fixed frame 65, and a cylinder 662 provided at an end of a rear of the extended tube 661. The cylinder 662 may be formed in such a way that a diameter of the extended tube 661 expands. The cylinder 662 may be open rearward and be provided therein with a bore.

The cylinder 662 may be provided with a first rotation limiting portion forming a rotation limiting structure of a knob, at an end of a rear thereof. The first rotation limiting portion may be a rotation limiting groove 663 formed in such a way that the end of the rear of the cylinder 662 is depressed forward. The rotation limiting groove 663 may be provided along a circumferential direction of the cylinder 662.

The frame 6 may be provided at the front of the panel 10, and include the outer rotation ring 67 coupled to the inner rotation ring 63 through the through hole 12 of the panel 10. A central portion of a rear surface of the outer rotation ring 67 may connect to an end of a front of the inner rotation ring 63. That is, the outer rotation ring 67 and the inner rotation ring 63 may be disposed respectively inside and outside of the panel 10, with the panel 10 therebetween and coupled to each other through the through hole 12.

A shaft supporting tube 676 that extends in the frontward-rearward direction may be provided at a center of the outer rotation ring 67. The shaft supporting tube 676 may include a portion that extends forward from the outer rotation ring 67, and a portion that extends rearward from the outer rotation ring 67. The shaft supporting tube 676 may support the first shaft 41.

The frame 6 may include knob ring 68 which is connected to an edge of the outer rotation ring 67, and protrudes forward. The knob ring 68 may connect to an edge of a front surface of the outer rotation ring 67. As described above, the knob ring 68 may be manufactured as an individual component and then assembled and connected to the outer rotation ring 67. Alternatively, the knob ring 68 may be integrated with the outer rotation ring 67.

A display 69 may be installed in or at an upper portion of the outer rotation ring 67 and in or at an upper portion of the knob ring 68. The display 69 may include a board 691, a board housing 692 that fixes the board 691 to the knob ring 68 and the outer rotation ring 67, and a transparent display cover 693 that covers and protects a screen of the display 69.

The inner rotation ring 63, the outer rotation ring 67, and the knob ring 68 may be integrally assembled and moved. The inner rotation ring 63 may be supported by the support frame 61 in the rotational direction and forward in the axial direction and supported rearward in the axial direction by the fixed frame 65. Accordingly, the inner rotation ring 63, the outer rotation ring 67, and the knob ring 68 may be supported by the support frame 61 and the fixed frame 65 in the axial direction and the rotational direction.

The first shaft 41 may connect to the knob 30 at the front of the panel 10, pass through the shaft supporting tube 676 and the tube frame 66, and then extend to an inner space of the cylinder 662.

Valve 80 that adjusts a flow rate of gas may be installed in the inner space defined by the panel 10. An adjusting piece 81 may be rotatably disposed in the valve 80. As a result of adjustment of a position of rotation of the adjusting piece 81, a flow rate of the gas may be adjusted. An end of a rear of the second shaft 42 may be fixedly inserted into the valve 80. The second shaft 42 may be provided with a key 43 (see FIG. 20) that extends in the radial direction, at the end of the rear thereof, and the adjusting piece 81 may be provided with a key groove 82 into which the key 43 may be inserted, at an end of a front thereof. An axial length of the key groove 82 may be greater than an axial length of the key 43. As the key 43 is inserted into the key groove 82, rotation of the second shaft 42 and rotation of the adjusting piece 81 may be mutually dependent. A valve spring 83 may provide an elastic force in a direction in which the second shaft 42 becomes farther away from the adjusting piece 81.

In a state in which the valve 80 is locked so as not to supply gas, the second shaft 42 may be pushed forward by the valve spring 83, and moved to a forwardmost position (a third axial position; see P3 in FIG. 11) from the valve 80 in the axial direction. In this state, the key 43 may interfere with a housing of the valve in the valve 80 in the circumferential direction, and the second shaft 42 may not rotate.

In a state in which a user pushes the second shaft 42 rearward in the axial direction against an elastic force of the valve spring 83 by a predetermined distance Vd and the second shaft 42 is further inserted into the valve 80 (a fourth axial position; see P4 in FIG. 16), the key 43 may not interfere with the housing of the valve in the circumferential direction, and the second shaft 42 may rotate.

Figure 17:
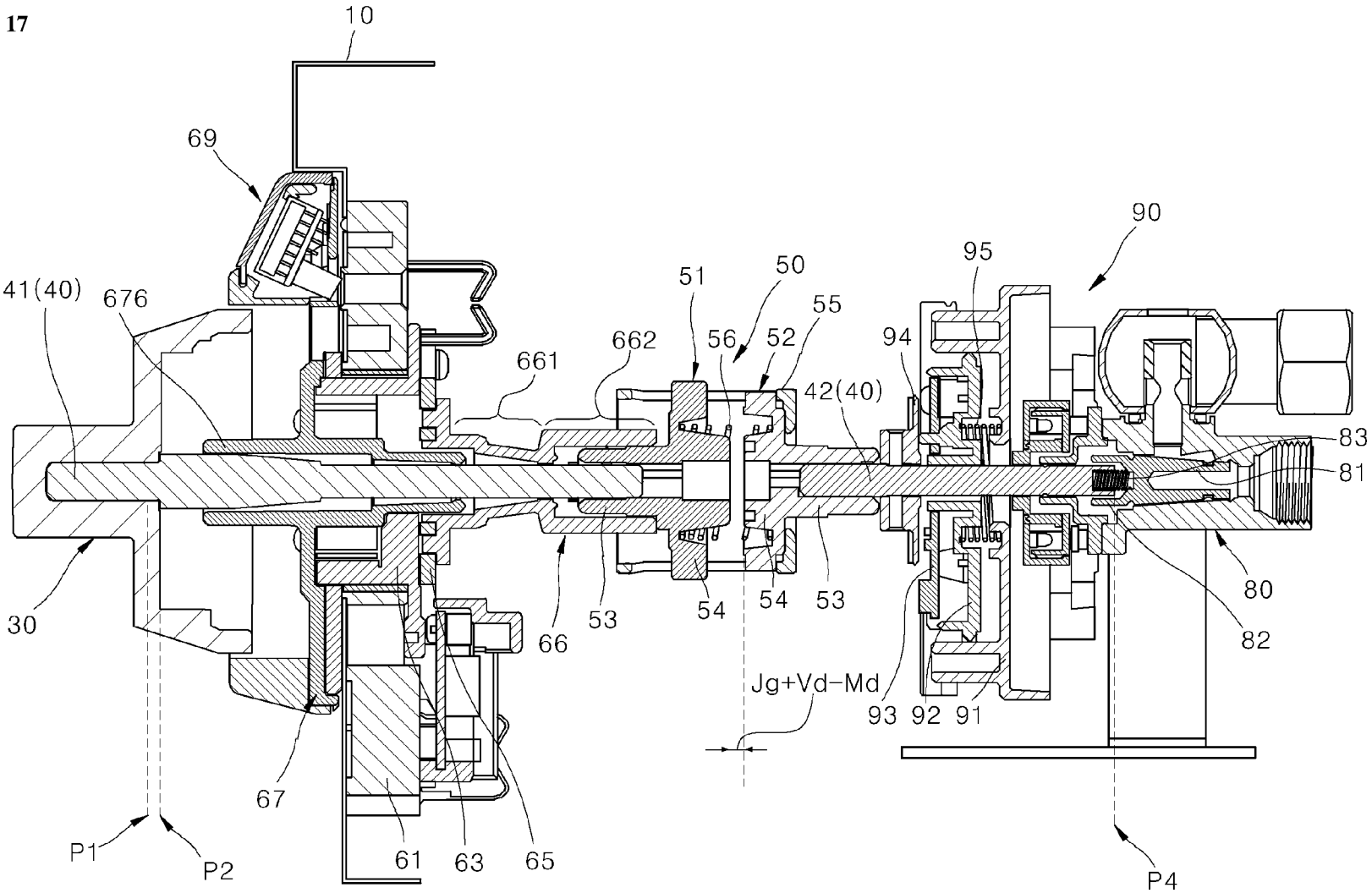
FIG. 17 is a view showing a state in which a second shaft is located at the fourth axial position and a first shaft is located at the second axial position when pushing of the knob rearward is stopped after the valve is opened.

In a state in which the valve is open at the fourth axial position as a result of rotation of the second shaft 42 and the adjusting piece 81, an end of a front of the key 43 may interfere with the housing of the valve in the axial direction, and despite elasticity of the valve spring 83, the second shaft 42 may stay at the fourth axial position P4 (see FIG. 17). Thus, as the second shaft 42 stays at the fourth axial position once the valve is open as a result of rotation of the second shaft 42 and the adjusting piece 81, the user may rotate the second shaft 42 to adjust an opening degree of the valve without further pushing the second shaft 42 rearward in the axial direction.

Figure 13:
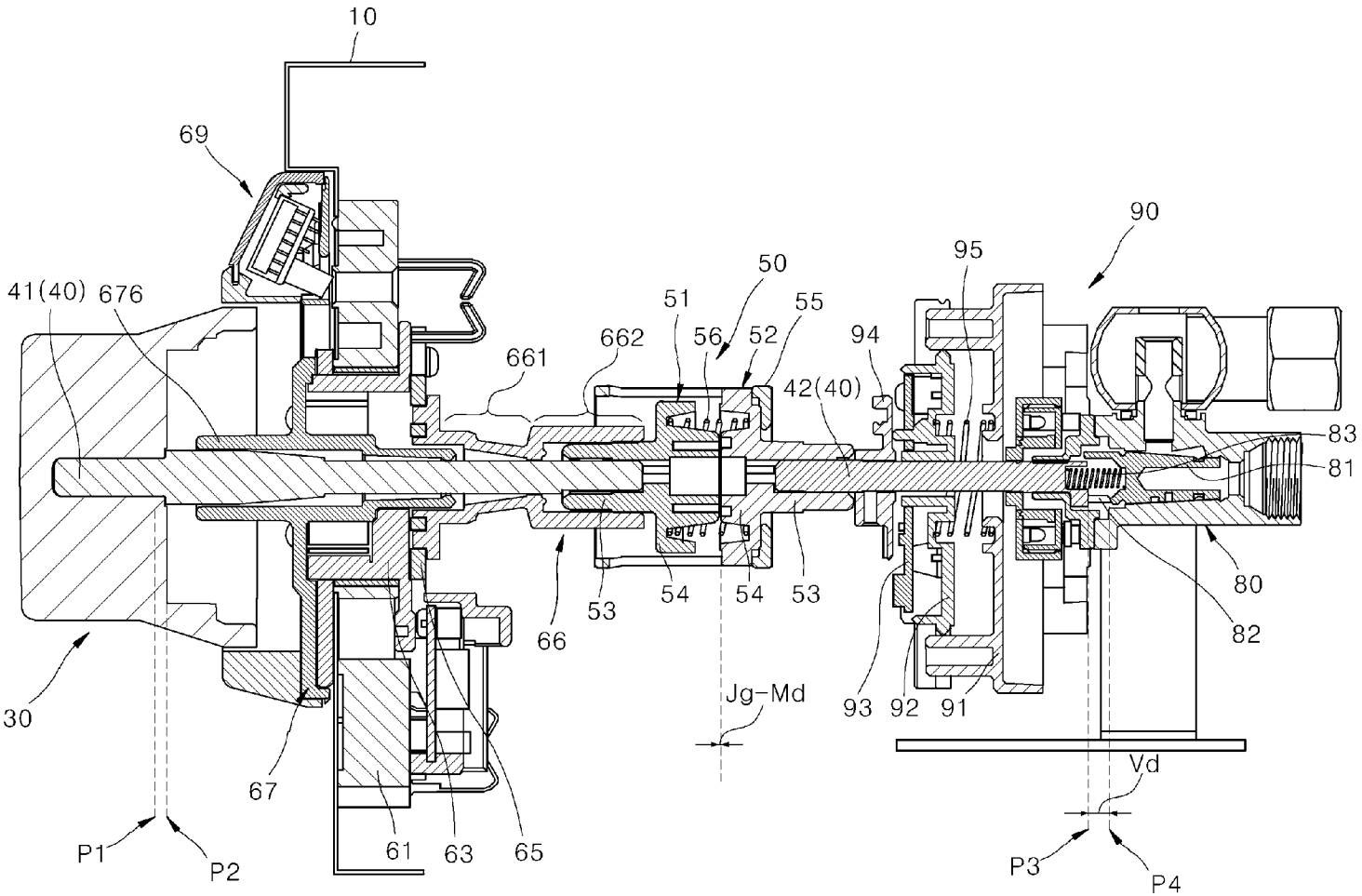
FIG. 13 is a view showing a first shaft moved to a second axial position as a result of a rearward push of the knob of FIG. 11.

When the second shaft 42 rotates to a locking position to lock the valve 80 from the state in which the valve 80 is open, the key 43, having interfered with the housing of the valve in the axial direction, may not interfere with the housing of the valve any longer, the second shaft 42 may return to the third axial position P3 from the fourth axial position P4 based on the elasticity of the valve spring 83 (see FIG. 13).

Second sensor 90 configured to sense an amount of rotation of the second shaft 42 may be disposed on a circumference of the second shaft 42 at a front of the valve 80. The second sensor 90 may include a sensor frame 91 fixed to the valve 80, a board frame 92 that makes a relative movement with respect to the sensor frame 91 in the axial direction without rotating, a sensor board 93 fixed to the board frame 92, a rotating plate 94 disposed at a front of the sensor board 93 and rotating together with the second shaft 42, and a sensor spring 95 provided between the sensor frame 91 and the board frame 92 and pushing the board frame 92 against the rotating plate 94. The rotating plate 94 may be directly fixed to the second shaft 42, or as illustrated, supported by a second shaft connector 52 of the joint 50 in the axial direction.

When directly being fixed to the second shaft 42, the rotating plate 94 may move together with the second shaft 42 in the axial direction and rotate together with the second shaft 42. When the rotating plate 94 is supported by the second shaft connector 52 in a state in which rotation of the rotating plate 94 is limited by the second shaft 42, the rotating plate 94 may move rearward with the second shaft 42 as the second shaft connector 52 pushes the rotating plate 94 at a time when the second shaft 42 moves rearward in the axial direction. That is, when the second shaft 42 rotates, the rotating plate 94 may rotate with the second shaft 42 as the second shaft 42 and the rotating plate 94 connect to each other in a way that relative rotation between them is limited or not allowed. When the second shaft 42 moves forward in the axial direction, the rotating plate 94 may be moved forward by elasticity of the sensor spring 95 along with the second shaft 42, in close contact with the second shaft connector 52.

The sensor board 93 and the board frame 92 may connect in a way that the sensor board 93 and the board frame 92 make a relative movement with respect to the second shaft 42 in the axial direction. Accordingly, despite the axial movement of the second shaft 42, a gap between the rotating plate 94 and the sensor board 93 may remain constant, and the rotating plate 94 and the sensor board 93 may move in the axial direction together with the second shaft 42. When the second shaft 42 rotates, the sensor board 93 may not rotate while the rotating plate 94 rotates with the second shaft 42.

Thus, the second sensor 90 may sense an amount of rotation of the second shaft 42 accurately as the gap between the rotating plate 94 and the sensor board 93 remains constant regardless of axial movement and the axial position of the second shaft 42.

The first shaft 41 may be supported by the frame 6 fixed to the panel 10, and the second shaft 42 may be supported by the valve 80 additionally installed in the inner space of the panel 10. Accordingly, due to assembly tolerance, axial positions and radial positions, for example, of the first shaft 41 and the second shaft 42 may not meet or match each other and be aligned with each other.

To prevent this from happening, the first shaft 41 and the second shaft 42 may be connected to each other by joint 50.

The joint 50 may include first shaft connector 51 connected to an end of a rear of the first shaft 41, second shaft connector 52 connected to an end of a front of the second shaft 42, and a housing 55 connected to the first shaft connector 51 in such a way that they are rotationally constrained to each other and connected to the second shaft connector 52 in such a way that they are rotationally constrained to each other.

The first shaft connector 51 may move in the axial direction together with the first shaft 41 and rotate together with the first shaft 41. Likewise, the second shaft connector 52 may move in the axial direction together with the second shaft 42 and rotate together with the second shaft 42.

A joint spring 56 may be built into the housing 55 to provide elasticity in a direction in which the first shaft connector 51 and the second shaft connector 52 become farther apart from each other. The joint spring 56 may be a compression coil spring that extends in the axial direction, and an end of one or a first side of the joint spring 56 may be supported by the first shaft connector 51 while an end of the other or a second side may be supported by the second shaft connector 52.

Figure 5:
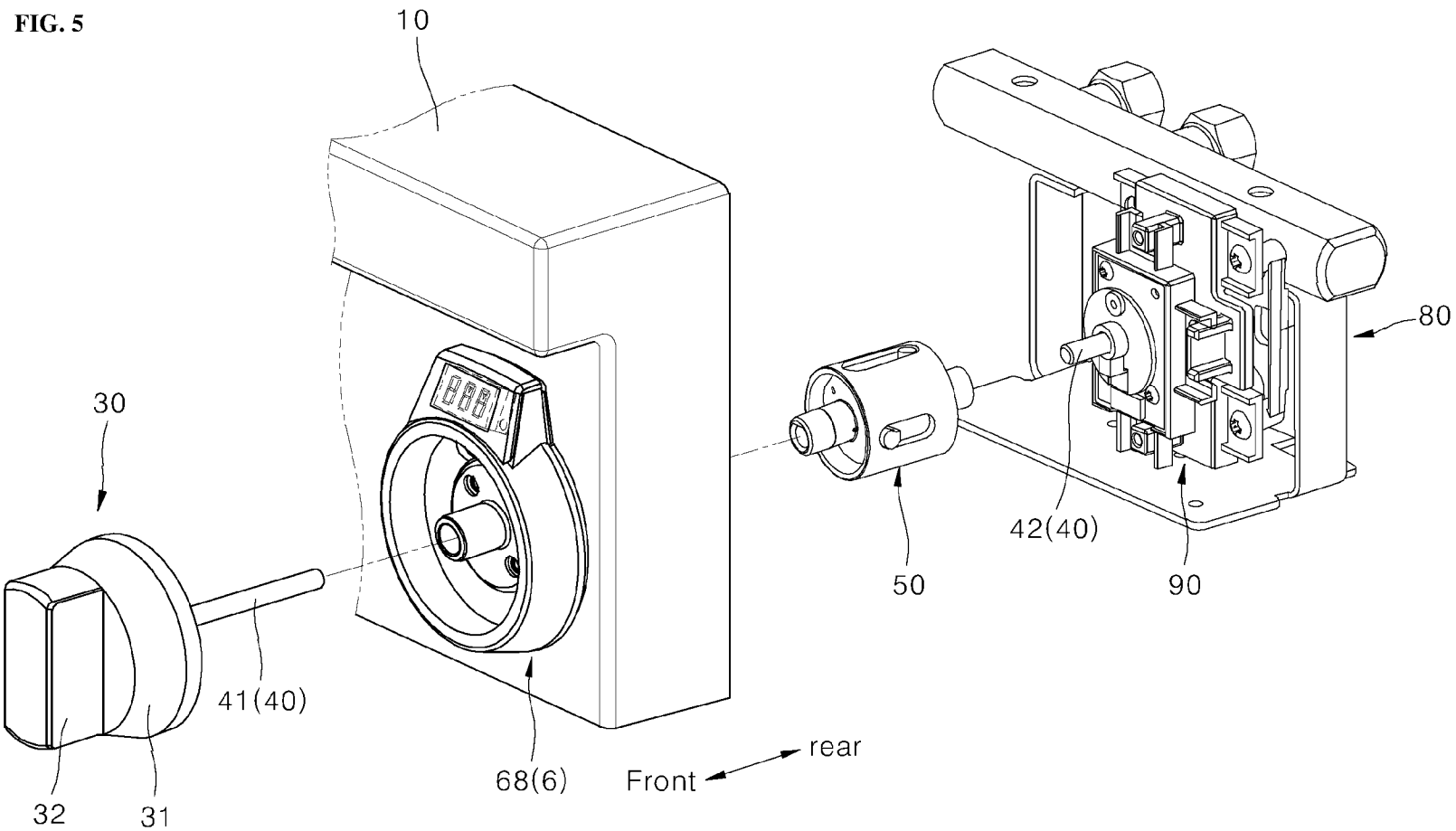
FIG. 5 is an exploded perspective view showing a portion of the knob assembly of FIG. 4.
Figure 6:
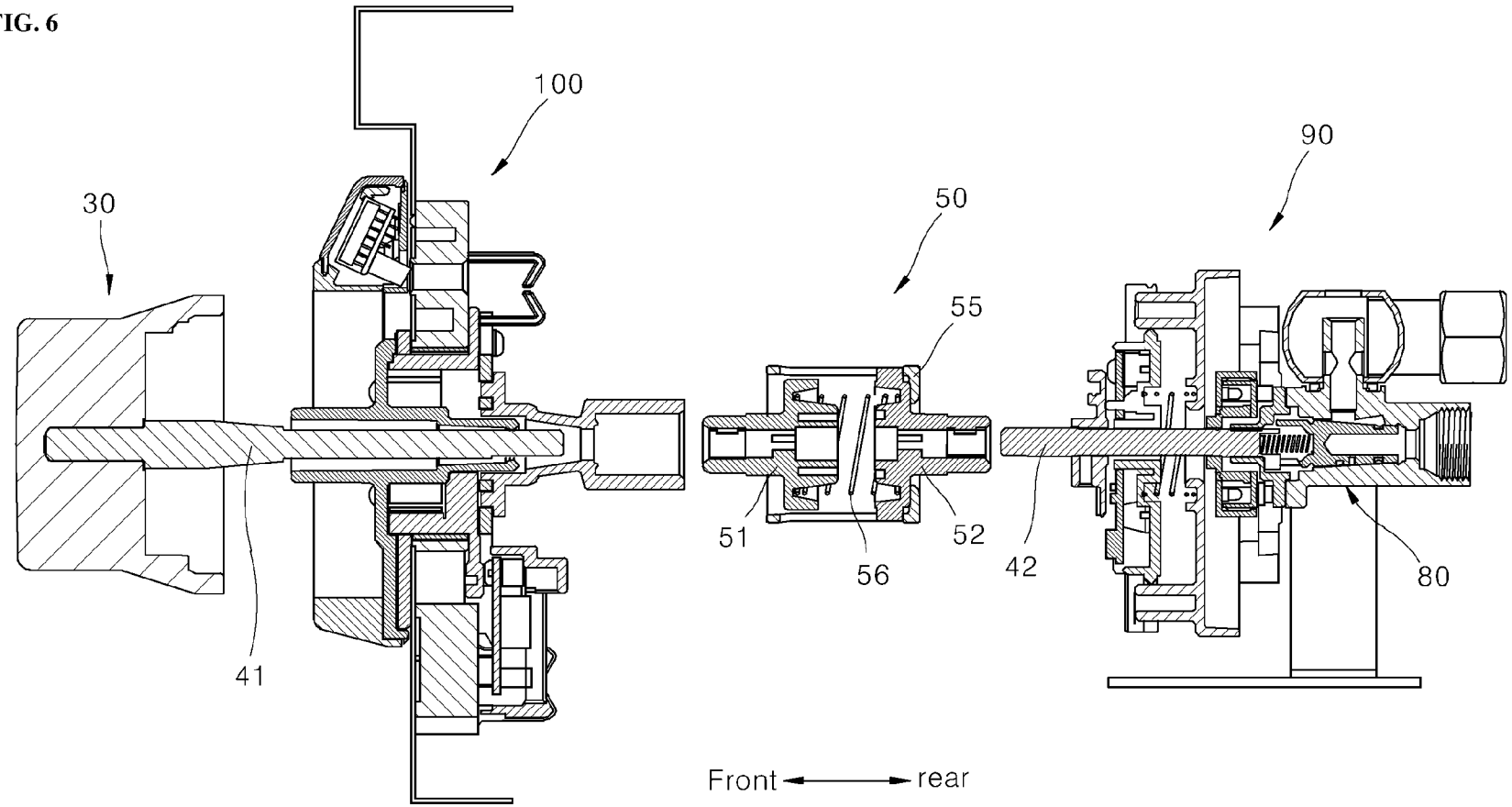
FIG. 6 is a side cross-sectional view of FIG. 5.

At least one of the first shaft connector 51 or the second shaft connector 52 may connect to the housing 55 in such a way that it makes relative movement with respect to the housing 55 in the axial direction. Accordingly, when an external force is not applied in the axial direction, the first shaft connector 51 and the second shaft connector 52, as illustrated in FIGS. 5 and 6, may be disposed farthest from each other within a range allowed by the housing 55. In this embodiment, the first shaft connector 51 and the second shaft connector 52 connect to the housing 55 in such a way that both the first shaft connector 51 and the second shaft connector 52 make a relative movement with respect to the housing 55 in the axial direction.

The first shaft connector 51 and the second shaft connector 52 may each have a substantially circular cross section and be provided with a small diameter portion 53 that extends in the axial direction, and a large diameter portion 54 connected to the small diameter portion 53 and having a diameter greater than a diameter of the small diameter portion/formed in a way that a diameter of the small diameter portion expands. The first shaft 41 and the second shaft 42 may respectively connect to the small diameter portions 53 of the first shaft connecting part 51 and the second shaft connector 52. Accordingly, the large diameter portions 54 of the first shaft connecting part 51 and the second shaft connecting part 54 may face each other, and a joint spring 56 may be interposed between the two large diameter portions 54 in a state of being compressed.

The large diameter portion 54 may be provided with a pair of slot shafts 541 that extends outward from a circumferential surface of the large diameter portion 54 in the radial direction. The pair of slot shafts 541 may be disposed on a straight line passing through a center of the large diameter portion.

The housing 55 may be provided with slots 551, 552 to which the slot shafts 541 are fitted. More specifically, the housing 55 may be provided with a pair of first slots 551 that extends in the axial direction and to which the slot shafts 541 of the first shaft connector 51 are fitted, and a pair of second slots 552 that extends in the axial direction and to which the slot shafts 541 of the second shaft connector 52 are fitted. The first slots 551 and the second slots 552 may be disposed at a 90-degree interval in the circumferential direction.

As the pair of slot shafts 541 and the slots 551, 552 may interfere with each other in a circumferential direction, a rotational force of the first shaft connector 51 may be delivered to the housing 55, and a rotational force of the housing 55 may be delivered to the second shaft connector 52.

The slot shafts 541 may move in the frontward-rearward direction in a state of being accommodated in the slots 551, 552. Accordingly, a relative axial distance between the first shaft connector 51 and the second connector 52 may differ.

The first shaft connector 51 and the second shaft connector 52 may respectively make a relative rotation with respect to the housing 55 around their own slot shaft 541. Additionally, as the pair of slot shafts 541 provided on the large diameter portion 54 moves by a different distance in the pair of slots (551 or 552) to which the slot shafts 541 are fitted, the pair of slot shafts 541 may make a relative rotation about an axis in a direction perpendicular to both the axial direction of the shaft 40 and a rotational axis of the slot shaft 541.

In a state in which the joint 50 is fitted between the first shaft 41 and the second shaft 42, there is a gap Jg (see FIG. 11) between the first shaft connector 51 and the second shaft connector 52 to some degree in the axial direction, but the joint spring 56 may be compressed slightly unlike the joint spring 56 in an initial state. That is, in the initial state in which the shaft 40 is not inserted into the joint 50, the first shaft connector 51 and the second shaft connector 52 may be disposed farthest away from each other within a range allowed by the slots 551, 552, as illustrated in FIGS. 5 and 6. When the joint 50 is installed between the first shaft 41 and the second shaft 42, the first shaft connector 51 and the second shaft connector 52 in FIG. 11 may become closer to each other than in FIGS. 5 and 6, and the joint spring 56 in FIG. 11 may further be compressed than in FIGS. 5 and 6.

The small diameter portion 53 of the first shaft connector 51 may be accommodated in a bore of the cylinder 662 of the frame 6. The large diameter portion 54 of the first shaft connector 51 may contact the end of the rear of the cylinder 662. The joint spring 56, further compressed than the joint spring 56 in an initial state, may push the first shaft connector 51 firmly against the cylinder 662.

The cylinder 662 may interfere with the large diameter portion 54 and align a axial position of the first shaft 41. Accordingly, a axial position of the knob 30 with respect to the panel 10 may be aligned accurately.

Further, the small diameter portion 53 may be accommodated in the cylinder 662. A circular inner circumferential wall of the cylinder 662 may align a center of the small diameter portion 53 while contacting a circular outer circumferential wall of the small diameter portion 53. Accordingly, a center of a shaft of the knob 30 may also be aligned with respect to the panel 10 accurately.

The first shaft connector 51 may be provided with a second rotation limiting portion 542 engaged with the first rotation limiting portion 663 of the cylinder 662. The second rotation limiting portion 542 may be a rotation limiting projection which may be fitted into or escape from the rotation limiting groove 663 in the axial direction.

The rotation limiting projection 542 may be provided in a boundary portion of the small diameter portion 53 and the large diameter portion 54. The rotation limiting projection 542 may extend from the large diameter portion 54 forward and extend from the small diameter portion 53 in the radial direction. Accordingly, a strength of the rotation limiting projection 542 may be improved.

A single rotation limiting projection 542 may be provided along the circumferential direction. When the knob 30 is in an initial position at which the knob 30 does not rotate, for example, at an off position (a position at which gas is not supplied and at which the valve is closed), circumferential positions of the rotation limiting groove 663 and the rotation limiting projection 542 may correspond to each other, and the rotation limiting projection 542 may be inserted into the rotation limiting groove 663.

The rotation limiting groove 663 may be provided at a first circumferential position C1 with respect to the cylinder 662. As the frame 6 is fixed to the panel 10, the first circumferential position C1 may not change.

The rotation limiting projection 542 may be provided at a second circumferential position C2 with respect to the first shaft connector 51. As the first shaft 41 and the first shaft connector 51 make a relative rotation with respect to the panel 10, the second circumferential position C2 may change as a result of rotation of the first shaft 41 and the first shaft connector 51.

Figure 10:
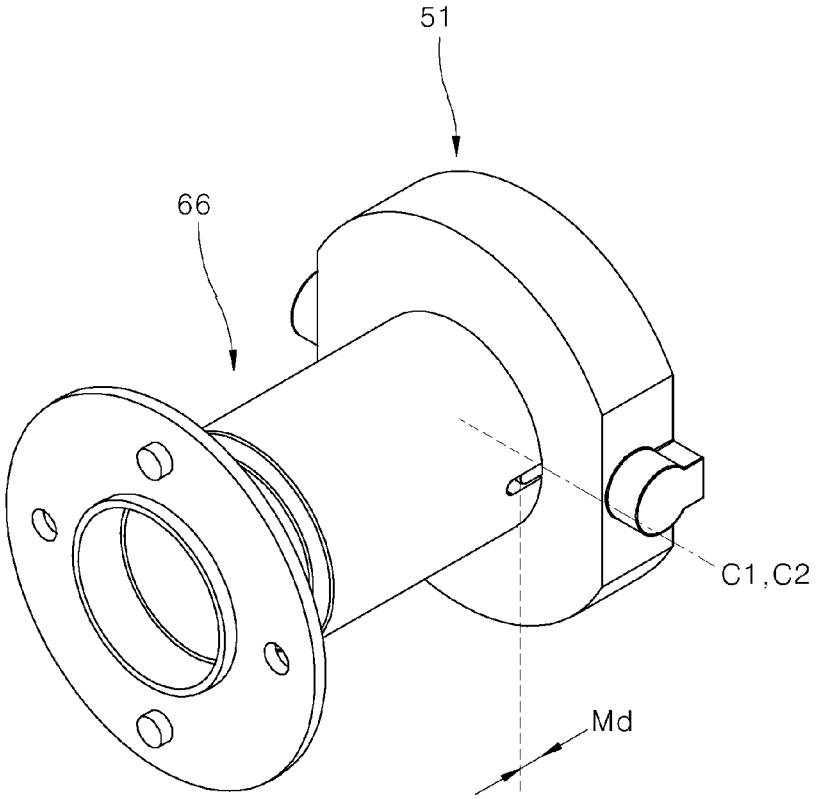
FIG. 10 is a perspective view showing the two components assembled in FIG. 9.
Figure 11:
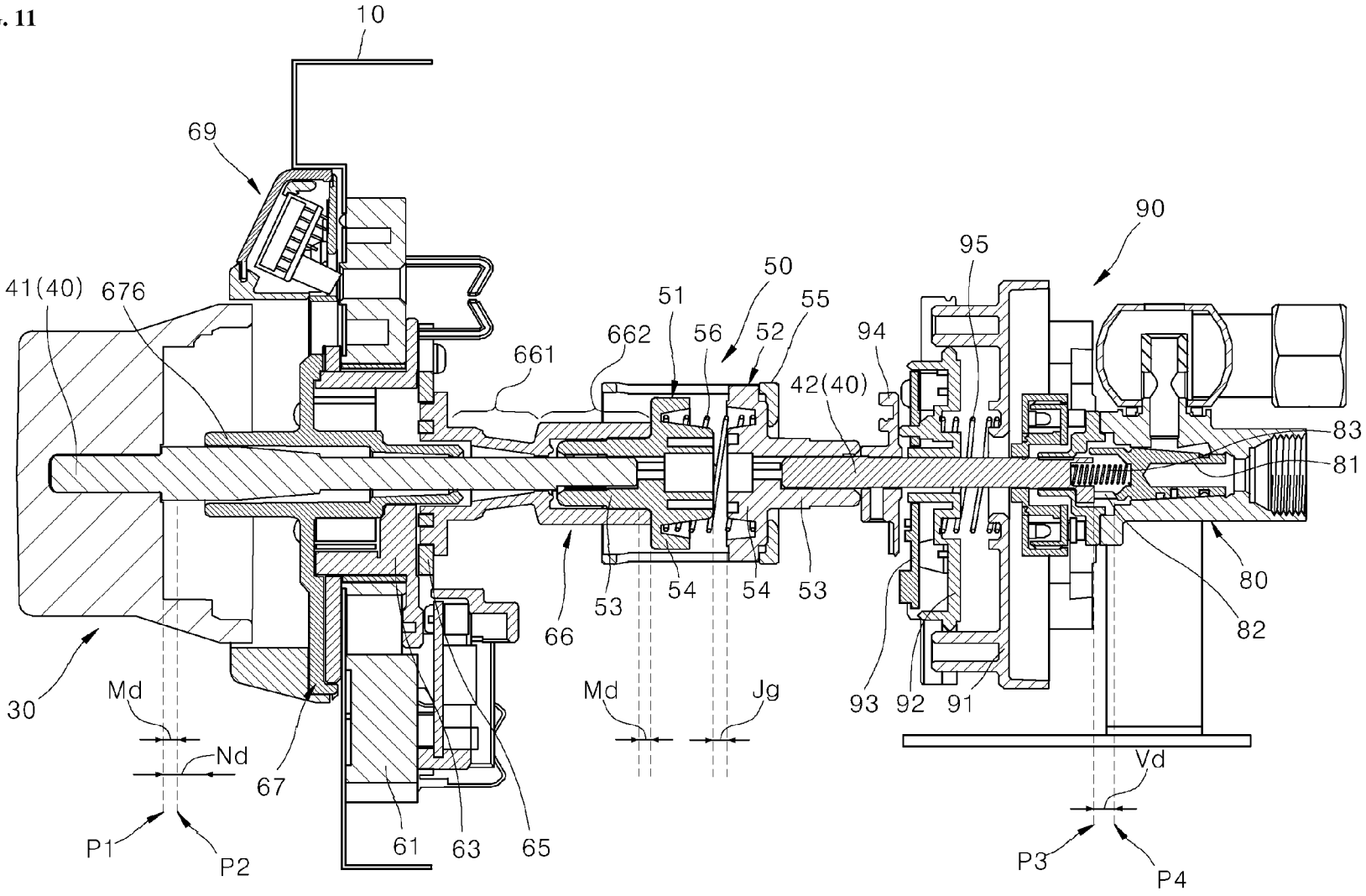
FIG. 11 is a side cross-sectional view of FIG. 4.
Figure 12:
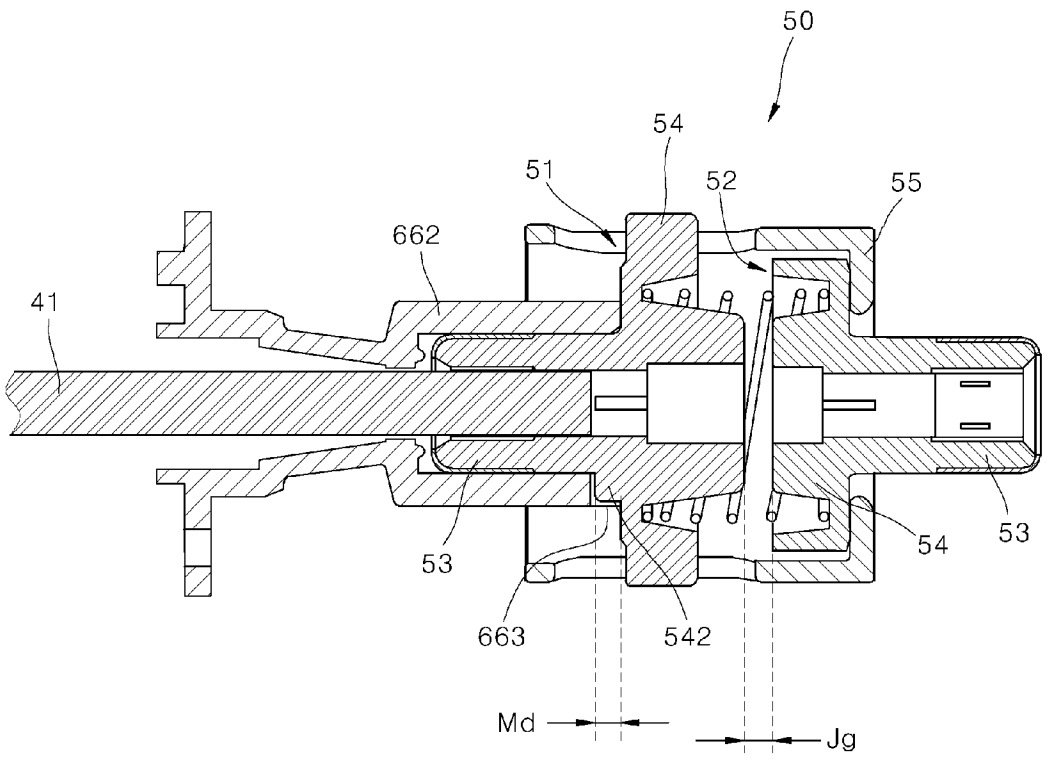
FIG. 12 is a planar cross-sectional view showing a portion of a shaft and a frame, and a joint viewed from above according to an embodiment.

In a state in which the first circumferential position C1 is aligned with the second circumferential position C2, the rotation limiting projection 542, as illustrated in FIGS. 10 and 12, may be inserted into the rotation limiting groove 663. In this state, the first shaft 41 and the first shaft connector 51 may be at the first axial position P1 (see FIG. 11).

When the first circumferential position C1 and the second circumferential position C2 are aligned and the first shaft 41 is at the first axial position P1, as described above, the second shaft 42 may be at the third axial position P3, and the valve 80 may be closed. That is, in the states of FIGS. 10 to 12, the knob 30 may be at the initial position, the first shaft 41 may be at the first axial position, the second shaft 42 may be at the third axial position, and the valve 80 may be closed.

In this state, as the rotation limiting projection 542 remains fitted into the rotation limiting groove 663, the knob 30 may not be rotated by an unintentional force even if the unintentional force is applied to the knob 30. That is, in this state, the knob 30 may rotate when the knob 30 is rotated while being pushed rearward in the axial direction.

Figure 14:
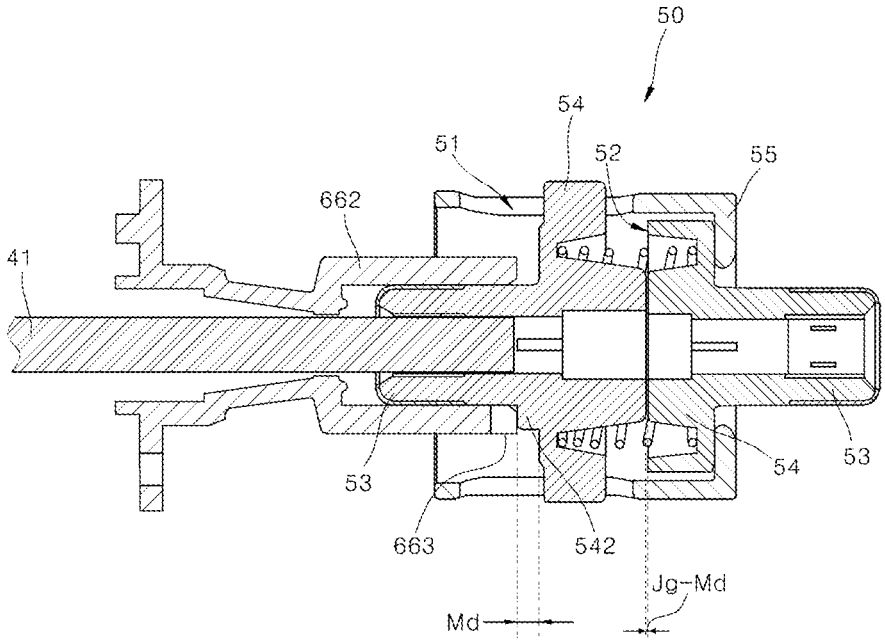
FIG. 14 is a view showing the first shaft of FIG. 12 moved to the second axial position.
Figure 15:
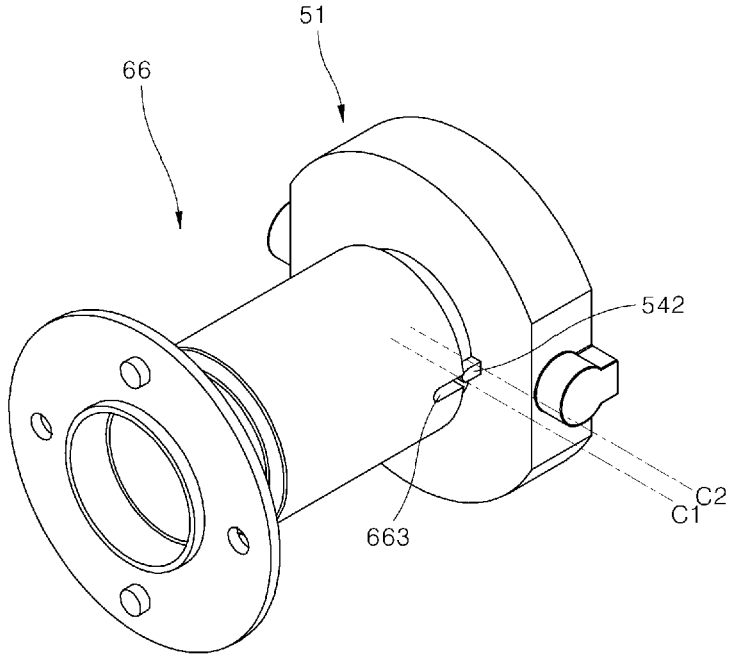
FIG. 15 is a view showing a frame and a rotation member in the state of FIG. 13.

When a user pushes the knob 30 rearward in the axial direction to open the valve 80, and the first shaft 41 moves to the second axial position P2 at which the rotation limiting projection 542 just escapes from the rotation limiting groove 663, as illustrated in FIGS. 13 to 15, circumferential interference between the cylinder 662 of the frame 6 and the first shaft connector 51 of the joint 50 may not occur. However, as a distance Jg between the first shaft connector 51 and the second shaft connector 52 may be greater than a axial distance Md (corresponding to an axial length of the rotation limiting projection) between the first axial position P1 and the second axial position P2, the end of the rear of the first shaft connector 51 has not yet contacted the end of the front of the second shaft connector 52, and the second shaft 42 may still stay at the third axial position P3.

Figure 16:
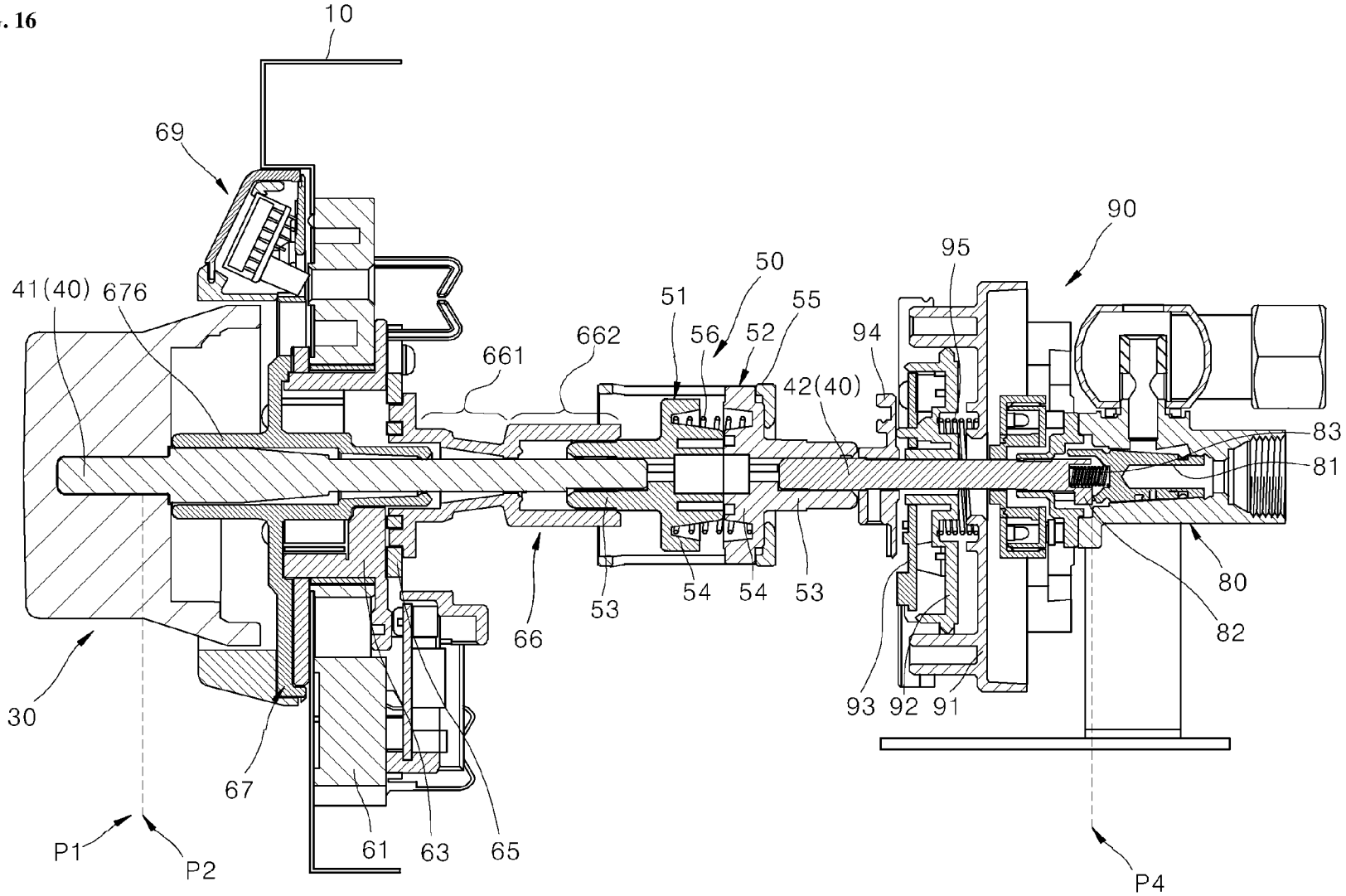
FIG. 16 is a view showing a state in which the first shaft is moved further rearward than the second axial position and the second shaft is moved to a fourth axial position by pushing the knob further rearward in FIG. 13.

As illustrated in FIGS. 13 to 15, in the state in which the first shaft 41 is at the second axial position P2 and the second shaft 42 is at the third axial position P3, the second shaft 42 cannot be rotated relatively with respect to the valve 80, and the knob 30 still cannot be rotated. Accordingly, when the user pushes the knob 30 further rearward in the axial direction such that the first shaft connector 51 contacts the second shaft connector 52 and then pushes the second shaft connector 52 further rearward in the axial direction to move the second shaft 42 to the fourth axial position P4, as illustrated in FIG. 16, the second shaft 42 can be rotated relatively with respect to the valve 80, and the user can rotate the knob 30. That is, when the user pushes the knob 30 rearward in the axial direction, the first shaft 41 may move further rearward than the second axial position P2, and when the second shaft 42 moves to the fourth axial position P4, the user can rotate the knob 30 to open the valve 80.

Figure 18:
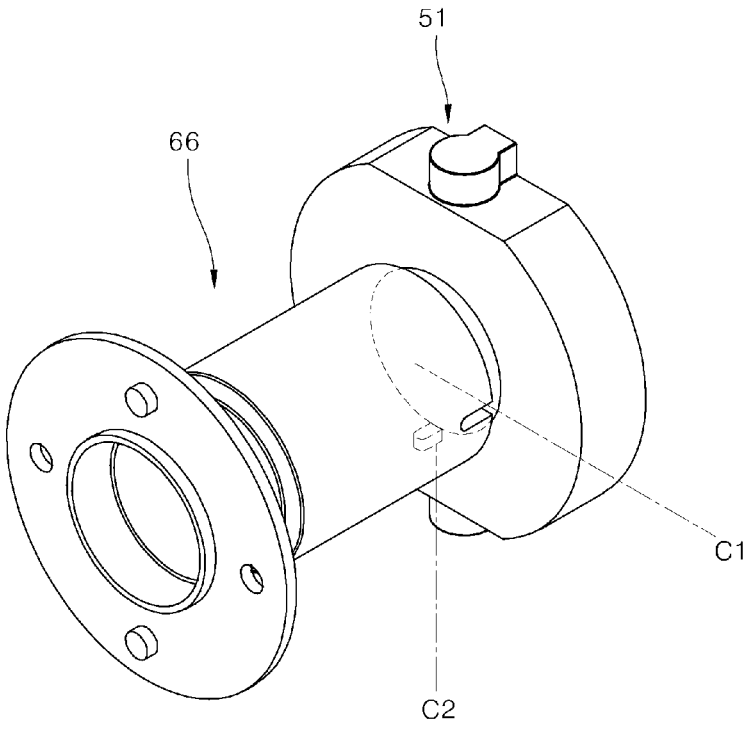
FIG. 18 is a view showing a frame and a rotation member in the state of FIG. 17.

When the user rotates the knob 80 and opens the valve 80, the second circumferential position C2 of the rotation limiting projection 542 may be out of the first circumferential position C1. When the user stops applying the force of pushing the knob 30 rearward in this state, the second shaft 42, as illustrated in FIG. 17, may stay at the fourth axial position P4 without moving again from the valve 80 forward, but the first shaft 41 may be moved forward by the joint spring 56 and moved to the second axial position P2 at which an end of a front of the rotation limiting projection 542 contacts the end of the rear of the cylinder 662. In FIGS. 17 and 18, the knob 30 makes a 90-degree rotation clockwise, and the second circumferential position C2 of the rotation limiting projection 542 is rotated by 90 degrees clockwise from the first circumferential position C1.

The state in FIG. 17 may be a state in which the end of the front of the rotation limiting projection 542 contacts the end of the rear of the cylinder 662, that is, a state in which the rotation limiting projection 542 is not engaged with the rotation limiting groove 663 and the valve 80 is open, although the knob 30 is not pushed rearward in the axial direction, Accordingly, the knob 30 is allowed to rotate. When the user rotates the knob 30 to the initial position to close the valve 80 in a state in which the second shaft 42 is at the fourth axial position P4 and the first shaft 41 is at the second axial position P2, as illustrated in FIG. 17, the second circumferential position C2 of the rotation limiting projection 542 may be aligned with the first circumferential position of the rotation limiting groove 663, and the second shaft 42 may also return to a position at which the valve 80 is closed. Accordingly, the first shaft 41 may be moved to the first axial position P1 by elasticity of the joint spring 56, and the second shaft 42 may be moved to the third axial position P3 by the valve spring 83. That is, the first shaft 41 and the second shaft 42 may return to the states in FIGS. 10 to 12.

Referring to FIG. 11, the knob 30 may move rearward until a center of a rear of the knob 30 contact a front of the shaft supporting tube 676. That is, the knob 30 itself may be allowed to move rearward by a distance Nd between the knob 30 and the shaft supporting tube 676. Then in a state in which the joint 50 is installed in the knob assembly 3, a distance by which the first shaft connector 51 makes a relative movement in the axial direction with respect to the second shaft connector 52 in the joint 50 may correspond to a gap Jg between the first shaft connector 51 and the second shaft connector 52. Additionally, a distance, by which the second shaft 42 is pushed rearward from the initial position to make a relative rotation with respect to the valve 80, may be a distance Vd between the third axial position P and the fourth axial position P4. When a relationship described hereunder is satisfied, $$Nd \geq Jg + Vd$$

The knob assembly 3 may operate smoothly.

Referring to FIG. 16, even in a state in which the first shaft 41 moves further rearward than the second axial position P2 and moves to a rearward most position, the small diameter portion 53 of the first shaft connector 51 may not escape from the cylinder 662. That is, the cylinder 662 may rotatably support the first shaft connector 51 while contacting the small diameter portion 53 at every axial position at which the first shaft 41 may be located. Accordingly, centers of the shafts of the first shaft 41 and the first shaft connector 51 may be aligned accurately even during operation of the knob 30.

In a state in which the valve 80 is open, as illustrated in FIG. 17, the rotation limiting projection 642 may move while contacting the end of the rear of the cylinder 662 when the knob 30 rotates. In this case, for the knob 30 to operate smoothly, friction between the rotation limiting projection 542 and the cylinder 662 needs to be reduced.

Referring to FIG. 11, in a state in which the valve 80 is closed, that is, the knob 30 is at the initial position, the joint spring 56 may generate an elastic restoring force in a compressed state by a distance Jg between the first shaft connector 51 and the second shaft connector 52 to push the first shaft connector 51 forward. Referring to FIG. 17, in the state in which the valve 80 is open, the joint spring 56 may generate an elastic restoring force in a compressed state by a distance Jg+Vd−Md between the first shaft connector 51 and the second shaft connector 52 to push the first shaft connector 51 forward.

As a force of pushing the first shaft connector 51 forward increases in the state of FIG. 11, the rotation limiting projection 542 may be engaged with the rotation limiting groove 663 more firmly, and a rotation limiting force with respect to the knob may increase. Conversely, as a force of pushing the first shaft connector 51 forward decreases in the state of FIG. 17, friction between the rotation limiting projection 542 and a surface of the rear end of the cylinder 662 may decrease. Accordingly, when a relationship described hereunder is satisfied, $$Vd>Md$$

A rotation limiting force with respect to the knob may increase, and when the knob rotates in the state in which the valve is open, friction between the rotation limiting projection and the cylinder may decrease.

A spring coefficient of the joint spring 56 may be less than a spring coefficient of the valve spring 83. That is, the joint spring 56 may have low elasticity while the valve spring 83 may have significantly high elasticity. Then when the first shaft 41 pushes the knob 30 in a state in which the first shaft 41 is at the first axial position P1, as illustrated in FIG. 11, and in a state in which the first shaft 41 is at the second axial position P2, as illustrated in FIG. 13, the valve spring 83 may hardly be compressed, and the joint spring 56 may be first compressed. Thus, even if the knob 30 is pushed by an unintentional external force, the second shaft 42 in charge of controlling the valve 80 may not move rearward in the axial direction.

A distance Md between the first axial position P1 and the second axial position P2 may be less that the distance Jg between the first shaft connector 51 and the second shaft connector 52 illustrated in FIG. 11. Suppose that a relationship described hereunder is satisfied.

$$Jg>Md$$

When the user pushes the knob to rotate the knob in the state in which the valve is closed, the rotation limiting projection 542 may completely escape from the rotation limiting groove 663 rearward in the axial direction before the first shaft connector 51 contacts the second shaft connector 52, as illustrated in FIG. 13. Accordingly, when the user pushes the knob 30 to release the knob 30 from the rotation limiting structure, the user may apply a force small enough to compress the joint spring 56 to readily release the knob 30 from the rotation limiting structure. When the relationship is satisfied, firm elasticity of the valve spring 83 may not be directly applied to the rotation limiting projection 542 regardless of a axial position of the first shaft 41 and the second shaft 42, a position to which the knob 30 rotates in the state in which the rotation limiting projection 542 contacts the cylinder 662, thereby preventing wear on the rotation limiting projection 542 and the cylinder 662.

Figure 19:
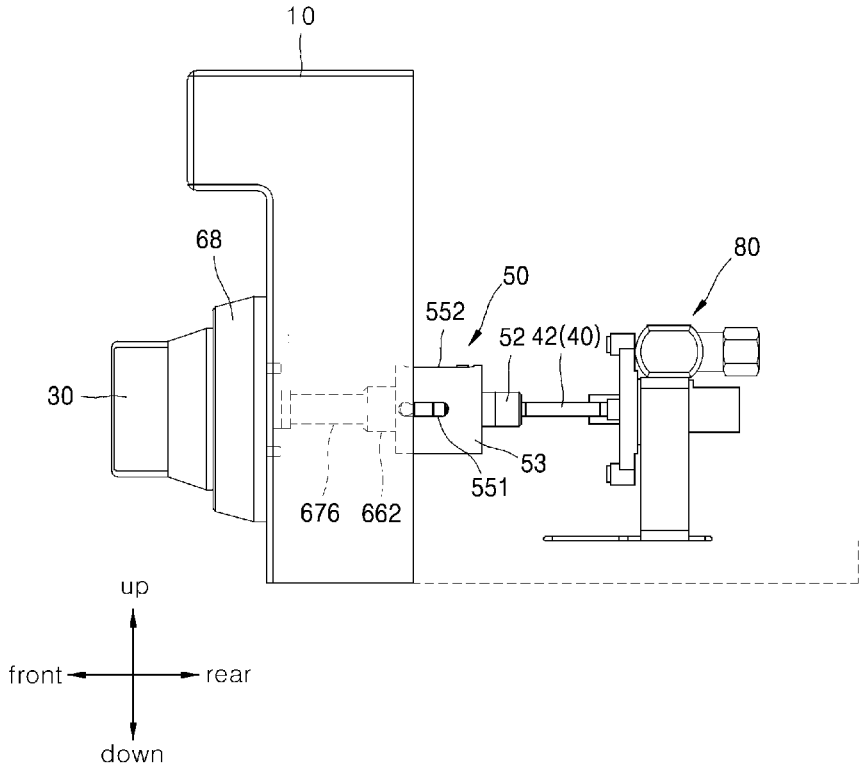
FIG. 19 is a side view showing a cooking appliance in which a knob assembly is installed according to another embodiment.
Figure 20:
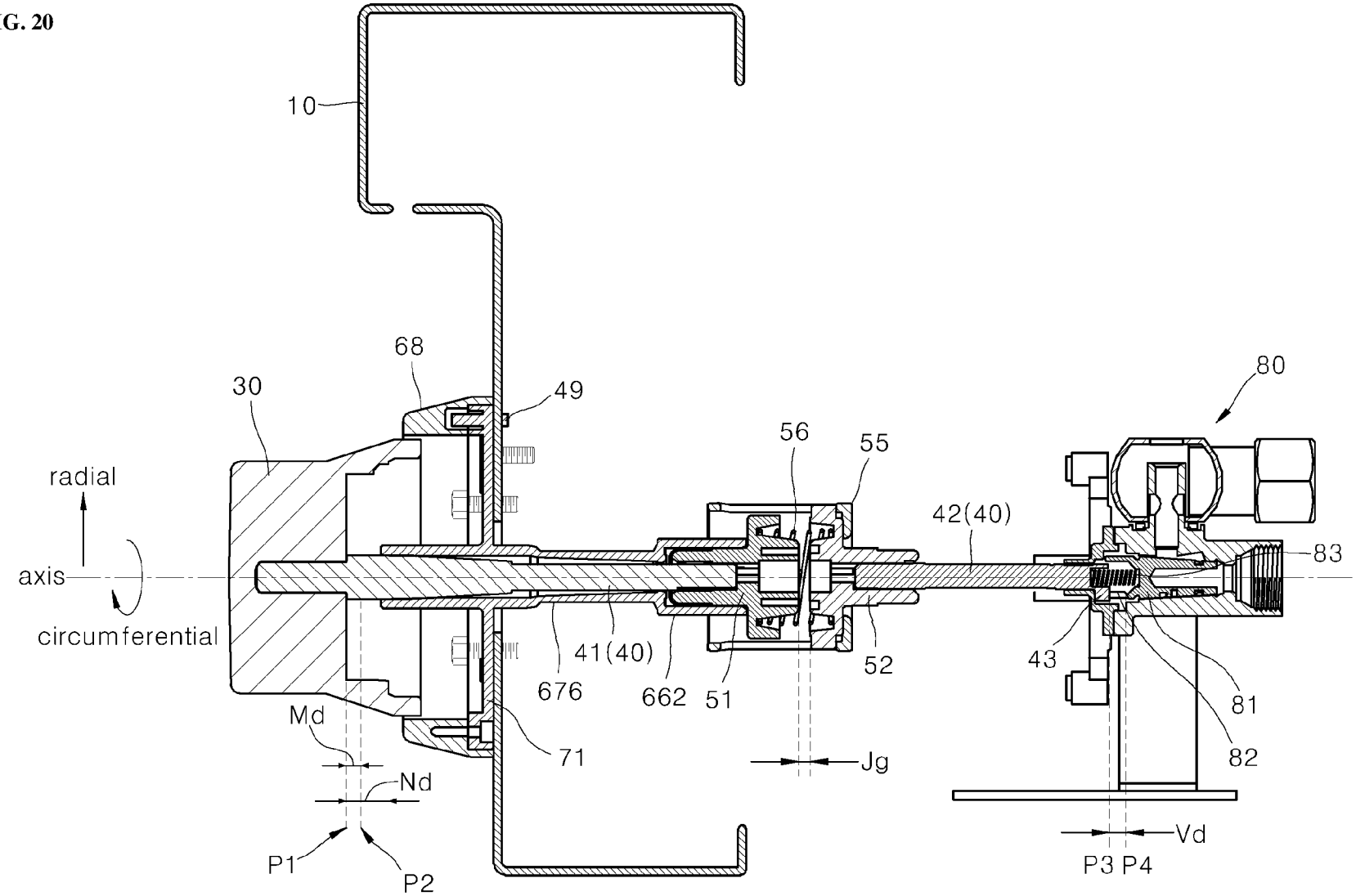
FIG. 20 is a side cross-section view of the knob assembly in FIG. 19.
Figure 21:
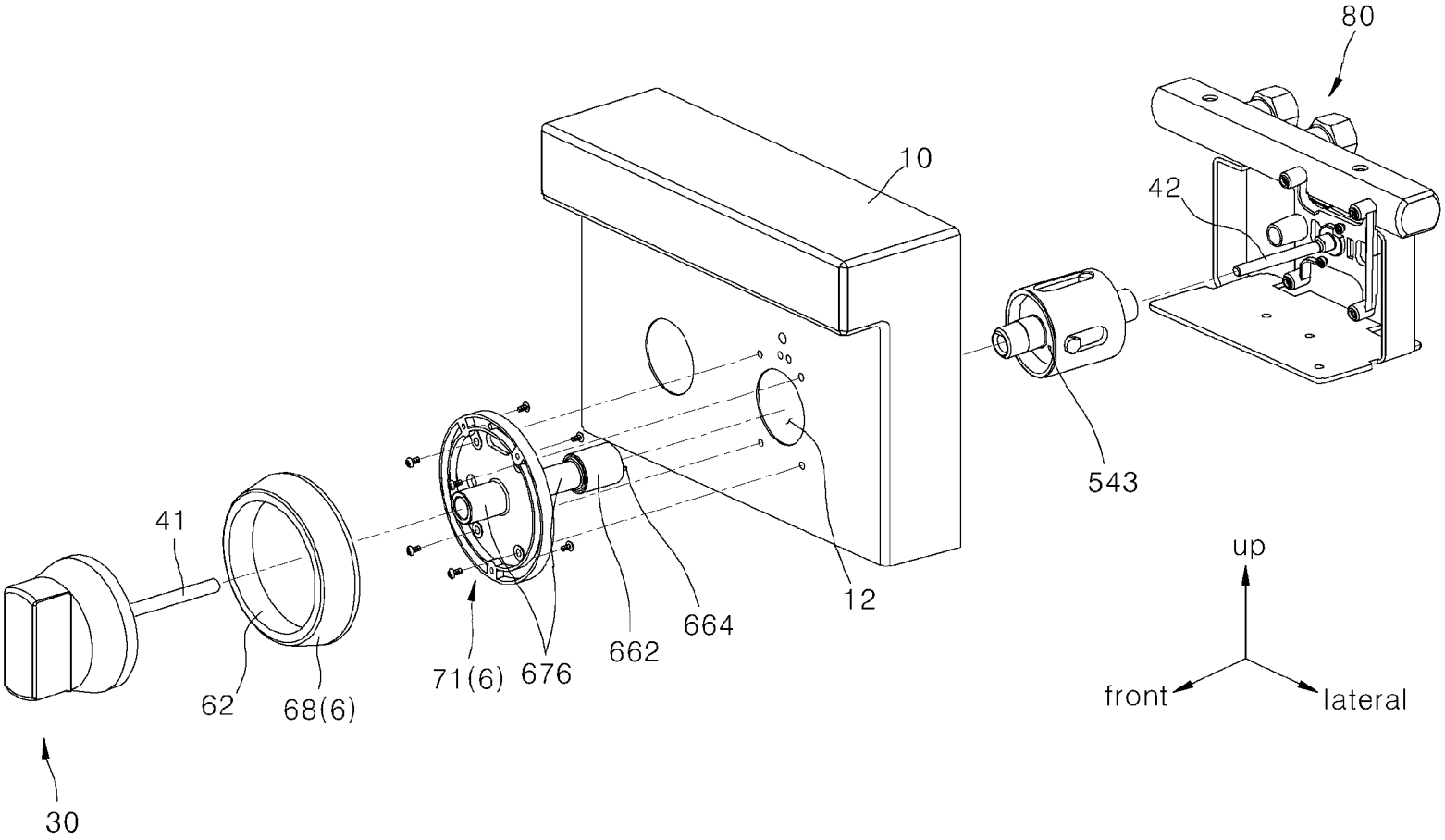
FIG. 21 is an exploded perspective view showing the knob assembly in FIG. 19.

A knob assembly, to which a knob rotation limiting structure is applied, according to another embodiment is described with reference to FIGS. 19 to 21. However, description of structure the same as the structure in the previous embodiment has been omitted. For example, knob 30, shaft 40, and valve 80 in this embodiment have the same structure as in the previous embodiment. Accordingly, repetitive description has been omitted.

The knob assembly in this embodiment differs from the knob assembly in the previous embodiment in that knob ring 68 is fixed to the knob assembly. That is, a component in the previous embodiment, provided for a rotation of the knob ring 68 in the frame 6, may be omitted in this embodiment.

Frame 6 of the knob assembly in this embodiment may include a component that remains fixed to the panel 10. The frame 6 may include a knob ring frame 71 that contacts and is fixed to a front surface of the panel 10 in such a way that the knob ring frame 71 covers the through hole 12 of the panel 10. The knob ring frame 71 may be provided with a shaft supporting tube 676 that extends in the frontward-rearward direction, at a center thereof. The shaft supporting tube 676 may include a portion that extends forward from the knob ring frame 71, and a portion that extends rearward from the knob ring frame 71. The shaft supporting tube 676 may support the first shaft 41.

The frame 6 may include knob ring 68 which is connected to an edge of the knob ring frame 71 and protrudes forward. The knob ring 68 may connect to an edge of a front surface of the knob ring frame 71. The knob ring 68 may be manufactured as an individual component and then assembled and connected to the knob ring frame 71 or integrated with the knob ring frame 71.

The shaft supporting tube 676 may be provided with cylinder 662 at an end of a rear thereof. The cylinder 662 may be formed in a way that a diameter of the shaft supporting tube 676 increases. The cylinder 662 may be open rearward and provided therein with a bore.

The cylinder 662 may be provided with a first rotation limiting portion forming a rotation limiting structure of the knob, at an end of a rear thereof. The first rotation limiting portion may be a rotation limiting boss 664 that protrudes rearward from the end of the rear of the cylinder 662. A single rotation limiting boss 664 may be provided along a circumferential direction of the cylinder.

First shaft 41 may connect to the knob 30 at the front of the panel 10, pass through the shaft supporting tube 676 and extend to an inner space of the cylinder 662. Valve 80 that adjusts a flow rate of gas may be installed in the inner space defined by the panel 10. Second shaft 42 may be installed in the valve 80. The first shaft 41 and the second shaft 42 may be connected to each other by joint 50.

First shaft connector 51 of the joint 50 may be provided with second rotation limiting portion 543 engaged with the first rotation limiting portion 664 of the cylinder 662. The second rotation limiting portion 543 may be rotation limiting groove 543, which is depressed rearward in the axial direction and into which the rotation limiting boss 664 may be fitted or from the rotation limiting boss 664 escapes.

The rotation limiting groove 543 may be provided on a front surface of large diameter portion 54 of the first shaft connector 51. A single rotation limiting groove 543 may be provided along a circumferential direction.

As described above, the projection and groove of the rotation limiting structure in this embodiment may be provided at positions opposite to the positions of the projection and groove in the previous embodiment. That is, for the rotation limiting structure, a groove may be provided to the cylinder, and a projection may be provided on the first shaft connector which is a rotation member, as in the previous embodiment, or a boss may be provided to the cylinder, and a groove may be provided to the first shaft connector, as in this embodiment.

The rotation limiting structure in the previous embodiment and the rotation limiting structure in this embodiment operate on the same theory and have the same effect, except that a distance Md between a first axial position and a second axial position of the first shaft 41 is determined based on a axial length of the rotation limiting projection 542 of the rotation member 51 in the previous embodiment and determined based on a axial length of the rotation limiting boss 664 of the frame 6 in this embodiment. That is, the knob in the previous embodiment and the knob in this embodiment operate on the same theory except that the knob ring is fixed to the knob in this embodiment.

To solve the above problems, embodiments disclosed herein provide a knob assembly to which a knob rotation limiting structure is applied, and a cooking appliance or a home appliance to which the knob assembly is applied, and the knob rotation limiting structure is implemented in a component for operation of a knob and requires no additional components, thereby causing no increase in the number of components and assembly man-hours.

Embodiments disclosed herein provide a knob assembly and a cooking appliance or a home appliance to which the knob assembly is applied, thereby ensuring smooth operation of a knob, and causing no noise during operation of a knob. Embodiments disclosed herein further provide a knob assembly structure that ensures simple management and repair.

Advantages are not limited to the above ones, and other advantages not mentioned above may be clearly understood from the description and may be more clearly understood from embodiments set forth herein. Additionally, advantages may be realized via means and combinations thereof that are described in the appended claims.

To achieve the above objectives, according to embodiments disclosed herein, a joint installed to reduce/remove a deviation in positions of a knob and a valve may be provided with a knob rotation limiting structure, thereby preventing an increase in the number of components and assembly man-hours. The knob rotation limiting structure may be provided to a frame installed in a panel of a cooking appliance and supporting rotation of a shaft, and to a rotation member rotating along with the knob.

The knob may connect to the shaft, move along with the shaft in a shaft or axial direction and rotate with the shaft. The rotation member may connect to the shaft, rotate along with the shaft in the axial direction, and move with the shaft. The rotation member may make a relative rotation with respect to the frame while the frame is fixed.

The frame and the rotation member may be provided with rotation limiting portions which are engaged with each other at a predetermined circumference-wise or circumferential position and at a predetermined shaft-wise or axial position and not engaged with each other outside of the positions.

When the knob is pushed in the axial direction, the rotation limiting portions may be disengaged from each other. When the rotation member is at a position out of the predetermined circumference-wise position, the rotation limiting portions may not be engaged with each other.

The shaft may be installed in a state in which the shaft is elastically supported in a forward direction by an elastic object. The frame may limit a range of a forward movement of the rotation member as a result of interference with the rotation member, thereby aligning a axial position of the knob accurately.

The rotation member may be a portion of a structure forming the joint. The frame and the joint may help to accurately align a position of the knob exposed to the outside of a home appliance. The frame and the joint may regulate a position of the knob accurately and allow the knob to operate smoothly despite a deviation in positions of the valve and the knob.

The knob rotation limiting structure may be provided to the frame and the joint, thereby preventing an increase in the number of components and assembly man-hour and ensuring ease of management and repairs of a knob assembly. More specifically, the knob assembly may be applied to a cooking appliance including a panel provided with a through hole, a knob assembly installed at the panel, and a valve disposed inside of the panel.

The knob assembly may include a knob disposed outside of the panel. The knob may connect to a shaft may extend rearward from the knob in the axial direction.

The shaft may pass through the through portion of the panel, extend in a frontward-rearward direction, move in the axial direction at least between a first axial position and a second axial position disposed further rearward than the first axial position, and rotate around a rotational center. The knob may connect to an end of a front of the shaft, move along with the shaft in the axial direction, and rotate with the shaft.

A frame configured to support rotation of the shaft may be installed to the panel. A rotation member configured to move along with the shaft in the axial direction and to rotate with the shaft may connect to the shaft. The rotation member may have a diameter larger than a diameter of the shaft.

A rotation limiting portion configured to prevent the knob from being rotated by an unintentional external force may be provided to the frame and the rotation member. The rotation limiting portion may include a first rotation limiting portion provided to the frame at a first circumferential position with respect to the rotational center, and a second rotation limiting portion provided to the rotation member at a second circumferential position with respect to the rotational center. The second rotation limiting portion may be engaged with the first rotation limiting portion at the first axial position and may interfere therewith in a circumferential direction of the rotational center in a state in which the first circumferential position and the second circumferential position correspond to each other.

The second rotation limiting portion may be disengaged from the first rotation limiting portion at the second axial position and may not interfere therewith in the circumferential direction of the rotational center of the shaft.

The second rotation limiting portion may not be engaged with the first rotation limiting portion at a position at which the first circumferential position and the second circumferential position do not correspond to each other.

The shaft may be elastically supported by an elastic object forward. The frame may limit forward movement of the rotation member.

The frame may limit forward movement of the rotation member at the first axial position, in the state in which the second circumferential position of the rotation member corresponds to the first circumferential position of the frame.

The frame may limit forward movement of the rotation member at the second axial position, in the state in which the second circumferential position of the rotation member is outside of the first circumferential position. The shaft may pass through the frame.

The first rotation limiting portion may be a rotation limiting groove depressed forward at an end of a rear of the frame. The second rotation limiting portion may be a rotation limiting projection that extends forward from the rotation member.

The shaft may include a first shaft connected to the knob, and a second shaft connected to the valve. A joint configured to connect the first shaft and the second shaft may be further provided between the first shaft and the second shaft.

The joint may include a first shaft connector connected to an end of a rear of the first shaft, configured to move along with the first shaft in the axial direction, and configured to rotate with the first shaft. The rotation member may be the first shaft connector.

The joint may include a second shaft connector connected to an end of a front of the second shaft and configured to rotate with the second shaft. The second shaft connector may move along with the second shaft in the axial direction.

The joint may include a housing connected to the first shaft connector in such a way that rotation of the housing about the shaft and rotation of the first shaft connector about the shaft are transmitted to each other, and connected to the second shaft connector in such a way that rotation of the housing about the shaft and rotation of the second shaft connector about the shaft are transmitted to each other. At least one of the first shaft connector or the second shaft connector may make a relative movement in the axial direction with respect to the housing.

The joint may further include a joint spring configured to elastically support the first shaft connector and the second shaft connector in a direction in which the first shaft connector and the second shaft connector become farther away from each other in the axial direction. The joint spring may be accommodated in the housing. The elastic object may be the joint spring.

The frame may be provided with a cylinder provided at an end of a rear of the frame and being open rearward. The first rotation limiting portion may be provided at the end of the rear of the cylinder.

The rotation member may be provided with a small diameter portion accommodated in the cylinder. The rotation member may be provided with a large diameter portion having a diameter greater than an inner diameter of the cylinder. At least a portion of the small diameter portion may be accommodated in the cylinder at the first axial position and the second axial position.

An end of a front of the large diameter portion may interfere with an end of a rear of the cylinder at the first axial position, thereby limiting forward movement of the rotation member. The large diameter portion may connect to the small diameter portion at a rear of the small diameter portion. The second rotation limiting portion may be a rotation limiting projection that extends forward from the large diameter portion, and extends from the small diameter portion in the centrifugal direction.

A knob ring that surrounds a radial outside of the knob may be provided outside of the panel.

In one embodiment, the frame may include a support frame that contacts the panel and fixed to the panel. The knob ring may be rotatably connected to the support frame.

The knob ring may be rotatably connected to the support frame through a rotation ring. That is, as the knob ring independently rotates with respect to the knob, the knob ring may implement another function.

The rotation ring may support rotation of the shaft. An outer rotation ring and an inner rotation ring may be assembled to form the rotation ring.

In another embodiment, the frame may include a knob ring frame that contacts the panel and fixed to the panel. The knob ring may be provided in such way that the knob ring is fixed to the knob ring frame. The knob ring frame may support rotation of the shaft.

In a knob assembly according to embodiments disclosed herein, additional components may not be required, and a knob rotation limiting structure may be implemented in a component for operation of a knob, thereby causing no increase in the number of components and assembly man-hours. In the knob assembly according to embodiments disclosed herein, the knob rotation limiting structure may make no noise and may operate smoothly.

According to embodiments disclosed herein, the knob rotation limiting structure need not be disassembled for management and repair of another component.

Specific effects are described along with the above-described effects in the section of Detailed Description, thereby ensuring ease of management and repairs.

The embodiments are provided only as an example, and the scope may be defined according to the appended claims rather than the above description. Further, it is to be understood that all modifications and changes drawn from the meaning and scope of the claims and equivalents thereof are included in the scope of the technical spirit of the disclosure.

The embodiments are described above with reference to a number of illustrative embodiments thereof. However, the embodiments are not intended to limit the embodiments and drawings set forth herein, and numerous other modifications and embodiments can be devised by one skilled in the art without departing from the technical spirit. Further, the effects and predictable effects based on the configurations are to be included within the range though not explicitly described in the description of the embodiments.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer, or section. Thus, a first element, component, region, layer, or section could be termed a second element, component, region, layer, or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cooking appliance, comprising:

a panel provided with a through hole;

a knob assembly installed at the panel; and a valve disposed inside of the panel, wherein the knob assembly comprises:

a shaft configured to pass through the through hole of the panel, extending in a frontward-rearward direction, configured to move in an axial direction at least between a first axial position and a second axial position disposed further rearward than the first axial position, and configured to rotate around a rotational center;

a knob disposed outside of the panel, connected to an end of a front of the shaft, configured to move with the shaft in the axial direction, and configured to rotate with the shaft;

a frame installed at the panel and configured to support rotation of the shaft;

a rotational member disposed inside of the panel, connected to the shaft, configured to move with the shaft in the axial direction, configured to rotate with the shaft, and having a diameter larger than a diameter of the shaft;

a first rotation limiting portion provided on the frame at a first circumferential position with respect to the rotational center;

a second rotation limiting portion provided on the rotational member at a second circumferential position with respect to the rotational center, and engaged with the first rotation limiting portion at the first axial position and interfering therewith in a circumferential direction of the rotational center in a state in which the first circumferential position and the second circumferential position correspond to each other, and disengaged from the first rotation limiting portion at the second axial position and not interfering therewith in the circumferential direction of the rotational center of the shaft; and an elastic member configured to elastically support the shaft in the forward direction, wherein in a state in which the second circumferential position corresponds to the first circumferential position, the frame limits forward movement of the rotational member at the first axial position, and wherein in a state in which the second circumferential position is outside of the first circumferential position, the frame limits forward movement of the rotational member at the second axial position.

2. The cooking appliance of claim 1, wherein the shaft passes through the frame.

3. The cooking appliance of claim 1, wherein the first rotation limiting portion is a rotation limiting groove depressed forward at an end of a rear of the frame, and the second rotation limiting portion is a rotation limiting projection that extends forward from the rotational member.

4. The cooking appliance of claim 1, wherein the shaft comprises:

a first shaft connected to the knob;

a second shaft connected to the valve; and a joint configured to connect the first shaft and the second shaft, and wherein the joint comprises:

a first shaft connector connected to an end of a rear of the first shaft, configured to move with the first shaft in the axial direction, and configured to rotate with the first shaft;

a second shaft connector connected to an end of a front of the second shaft, configured to move with the second shaft in the axial direction, and configured to rotate with the second shaft; and a housing connected to the first shaft connector in such a way as to be rotationally constrained, and connected to the second shaft connector in such a way as to be rotationally constrained, wherein the rotational member is the first shaft connector.

5. The cooking appliance of claim 4, wherein at least one of the first shaft connector and the second shaft connector makes a relative translation with respect to the housing in the axial direction, wherein the joint further comprises:

a joint spring disposed in the housing and configured to elastically support the first shaft connector and the second shaft connector in a direction in which the first shaft connector and the second shaft connector become farther away from each other in the axial direction, and wherein the elastic component is the joint spring.

6. The cooking appliance of claim 1, wherein the frame is provided with a cylinder provided at an end of a rear of the frame and open rearward, and wherein the first rotation limiting portion is disposed at the end of the rear of the cylinder.

7. The cooking appliance of claim 6, wherein the rotational member is provided with a large diameter portion having a diameter greater than an inner diameter of the cylinder, and limits forward movement of the rotational member as a result of interference between the end of the rear of the cylinder and an end of a front of the large diameter portion at the first axial position.

8. The cooking appliance of claim 7, wherein the second rotation limiting portion is a rotation limiting projection that extends forward from the large diameter portion.

9. The cooking appliance of claim 6, wherein the rotational member is provided with a small diameter portion accommodated in the cylinder, and at least a portion of the small diameter portion is accommodated in the cylinder at the first axial position and the second axial position.

10. The cooking appliance of claim 9, wherein the second rotation limiting portion extends from the small diameter portion in a centrifugal direction.

11. The cooking appliance of claim 9, wherein the rotational member is provided with a large diameter portion connected to the small diameter portion at a rear of the small diameter portion, and having a diameter greater than an inner diameter of the cylinder, and wherein the second rotation limiting portion is a rotation limiting projection that extends forward from the large diameter portion, and extends from the small diameter portion in the centrifugal direction.

12. The cooking appliance of claim 1, wherein the frame comprises a shaft supporting tube that contacts an outer circumferential surface of the shaft and configured to support rotation of the shaft, wherein a position of the shaft supporting tube is fixed with respect to the panel, and wherein the first rotation limiting portion is provided at an end of a rear of the shaft supporting tube.

13. The cooking appliance of claim 12, wherein the frame comprises a knob ring frame fixed to the panel at a front of the panel, and wherein the shaft supporting tube is provided to the knob ring frame.

14. The cooking appliance of claim 13, wherein the frame further comprises a knob ring that surrounds an outside of the knob in a radial direction, outside of the panel, and wherein the knob ring is fixed to the panel through the knob ring frame.

15. The cooking appliance of claim 1, wherein the frame comprises:

a support frame that contacts the panel and is fixed to the panel; and a tube frame fixed to the support frame and that extends rearward, wherein the first rotation limiting portion is provided at an end of a rear of the tube frame.

16. The cooking appliance of claim 15, wherein the frame further comprises:

a knob ring that surrounds an outside of the knob in a radial direction, outside the panel, and wherein the knob ring is rotatably connected to the support frame through an outer rotation ring.

17. The cooking appliance of claim 16, wherein the outer rotation ring is provided with a shaft supporting tube that contacts an outer circumferential surface of the shaft and configured to support rotation of the shaft.

18. A cooking appliance, comprising:

a panel provided with an opening;

a knob assembly installed at the panel; and a valve disposed inside of the panel, wherein the knob assembly comprises:

a shaft configured to pass through the opening in the panel in a frontward-rearward direction, and configured to move in an axial direction at least between a first axial position and a second axial position disposed further rearward than the first axial position, and configured to rotate around a rotational center;

a knob disposed outside of the panel, connected to a front end of the shaft, and configured to move with the shaft in the axial direction and rotate with the shaft;

a frame installed at the panel and configured to support rotation of the shaft;

a rotational member connected to the shaft, configured to move with the shaft in the axial direction, configured to rotate with the shaft, and having a diameter larger than a diameter of the shaft;

a rotation limiting groove provided on the frame at a first circumferential position;

a rotation limiting protrusion provided on the rotational member at a second circumferential position, and configured to be engaged with the rotation limiting groove at the first axial position in a state in which the first circumferential position and the second circumferential position correspond to each other, and disengaged from the rotation limiting groove at the second axial position; and a spring configured to elastically support the shaft in the forward direction, wherein in a state in which the second circumferential position corresponds to the first circumferential position, the frame limits forward movement of the rotational member at the first axial position, and wherein in a state in which the second circumferential position is outside of the first circumferential position, the frame limits forward movement of the rotational member at the second axial position.

19. The cooking appliance of claim 18, wherein the rotation limiting groove is depressed forward at an end of a rear of the frame, and the rotation limiting protrusion extends forward from the rotational member.

20. A cooking appliance, comprising:

a panel provided with an opening;

a knob assembly installed at the panel; and a valve disposed inside of the panel, wherein the knob assembly comprises:

a shaft configured to pass through the opening in the panel in a frontward-rearward direction, and configured to move in an axial direction at least between a first axial position and a second axial position disposed further rearward than the first axial position, and configured to rotate around a rotational center, the shaft including a first shaft connected to the knob, a second shaft connected to the valve, and a joint configured to connect the first shaft and the second shaft;

a knob disposed outside of the panel, connected to a front end of the shaft, and configured to move with the shaft in the axial direction and rotate with the shaft;

a frame installed at the panel and configured to support rotation of the shaft;

a rotational member connected to the shaft, configured to move with the shaft in the axial direction, configured to rotate with the shaft, and having a diameter larger than a diameter of the shaft, the rotation member being a first shaft connector of the joint connected to the first shaft;

a rotation limiting groove provided on the frame at a first circumferential position with respect to the rotational center;

a rotation limiting protrusion provided on the first shaft connector at a second circumferential position, and configured to be engaged with the rotation limiting groove at the first axial position in a state in which the first circumferential position and the second circumferential position correspond to each other, and disengaged from the rotation limiting groove at the second axial position; and a spring configured to elastically support the shaft in the forward direction, wherein in a state in which the second circumferential position corresponds to the first circumferential position, the frame limits forward movement of the first shaft connector at the first axial position, and wherein in a state in which the second circumferential position is outside of the first circumferential position, the frame limits forward movement of the first shaft connector at the second axial position.

* * * * *